US009687697B2

(12) United States Patent
Shigemitsu

(10) Patent No.: US 9,687,697 B2
(45) Date of Patent: Jun. 27, 2017

(54) MULTI-PIECE GOLF BALL

(71) Applicant: Dunlop Sports Co. Ltd., Kobe-shi, Hyogo (JP)

(72) Inventor: Takahiro Shigemitsu, Kobe (JP)

(73) Assignee: DUNLOP SPORTS CO. LTD., Kobe-shi, Hyogo (JP)

( * ) Notice: Subject to any disclaimer, the term of this patent is extended or adjusted under 35 U.S.C. 154(b) by 180 days.

(21) Appl. No.: 14/314,460

(22) Filed: Jun. 25, 2014

(65) Prior Publication Data

US 2015/0005102 A1 Jan. 1, 2015

(30) Foreign Application Priority Data

Jun. 26, 2013 (JP) ..... 2013-133805
Jun. 26, 2013 (JP) ..... 2013-133807

(51) Int. Cl.
*A63B 37/00* (2006.01)
*A63B 45/00* (2006.01)

(52) U.S. Cl.
CPC ..... *A63B 37/0076* (2013.01); *A63B 37/0039* (2013.01); *A63B 37/0043* (2013.01);
(Continued)

(58) Field of Classification Search
CPC ..... A63B 37/0076; A63B 37/0092; A63B 37/0059
See application file for complete search history.

(56) References Cited

U.S. PATENT DOCUMENTS 6,271,296 B1 8/2001 Nakamura et al.
6,461,251 B1 * 10/2002 Yamagishi ..... A63B 37/0003 473/376
(Continued)

FOREIGN PATENT DOCUMENTS

CN 101842430 A 9/2010
JP 2001-17575 A 1/2001
(Continued)

OTHER PUBLICATIONS

Extended European Search Report issued Nov. 6, 2014, in European Patent Application No. 14173808.8.
(Continued)

*Primary Examiner* — John E Simms, Jr.
(74) *Attorney, Agent, or Firm* — Birch, Stewart, Kolasch & Birch, LLP

(57) ABSTRACT

Provided is a golf ball showing a low spin rate on driver shots and a high spin rate on approach shots. Also provided is a multi-piece golf ball comprising a center and n (n is a natural number of 3 or more) envelope layers covering the center, wherein material hardness of the envelope layers satisfies H2<H0<Hn−1; where the envelope layers formed in order from the center side are referred to as a first envelope layer, a second envelope layer, a third envelope layer, a fourth envelope layer, . . . an n−1th envelope layer and an nth envelope layer (the outmost layer), respectively and H0 is a material hardness (Shore D hardness) of the center, and H1, H2, H3, H4, . . . Hn−1 and Hn are material hardness (Shore D hardness) of the first envelope layer, the second envelope layer, the third envelope layer, the fourth envelope layer, . . . the n−1th envelope layer and the nth envelope layer (the outmost layer), respectively; and the center is formed from a thermoplastic resin composition, and the second envelope layer is formed from a thermoplastic resin composition or a rubber composition.

18 Claims, 1 Drawing Sheet

(52) U.S. Cl.
CPC ..... *A63B 37/0045* (2013.01); *A63B 37/0051* (2013.01); *A63B 37/0059* (2013.01); *A63B 37/0062* (2013.01); *A63B 37/0064* (2013.01); *A63B 37/0092* (2013.01); *A63B 37/0038* (2013.01); *A63B 45/00* (2013.01)

(56) References Cited

U.S. PATENT DOCUMENTS

| | | | | |
|---|---|---|---|---|
| 7,393,288 | B2 | 7/2008 | Egashira et al. | |
| 7,892,112 | B2 | 2/2011 | Egashira et al. | |
| 8,487,027 | B2 | 7/2013 | Iizuka et al. | |
| 8,669,312 | B2 | 3/2014 | Iizuka et al. | |
| 8,669,313 | B2 | 3/2014 | Iizuka et al. | |
| 9,005,052 | B1 * | 4/2015 | Parnell | A63B 37/0051 473/376 |
| 2001/0005699 | A1 | 6/2001 | Morgan et al. | |
| 2005/0176523 | A1 * | 8/2005 | Boehm | A63B 37/0003 473/354 |
| 2006/0106175 | A1 | 5/2006 | Rajagopalan et al. | |
| 2006/0293121 | A1 | 12/2006 | Egashira et al. | |
| 2007/0207879 | A1 | 9/2007 | Sullivan et al. | |
| 2008/0096693 | A1 | 4/2008 | Boehm et al. | |
| 2008/0227569 | A1 | 9/2008 | Egashira et al. | |
| 2009/0011864 | A1 * | 1/2009 | Ladd | A63B 37/0062 473/376 |
| 2009/0118040 | A1 | 5/2009 | De Garavilla | |
| 2009/0181795 | A1 | 7/2009 | Sullivan et al. | |
| 2009/0181801 | A1 | 7/2009 | Sullivan et al. | |
| 2010/0048326 | A1 | 2/2010 | Kimura et al. | |
| 2010/0081517 | A1 * | 4/2010 | Sullivan | A63B 37/0003 473/373 |
| 2011/0053707 | A1 | 3/2011 | Ishii et al. | |
| 2011/0082243 | A1 | 4/2011 | Iizuka et al. | |
| 2011/0082244 | A1 | 4/2011 | Iizuka et al. | |
| 2011/0082245 | A1 | 4/2011 | Iizuka et al. | |
| 2012/0100933 | A1 * | 4/2012 | Watanabe | A63B 37/0031 473/373 |
| 2013/0012338 | A1 * | 1/2013 | Snell | A63B 37/0003 473/373 |
| 2013/0085015 | A1 | 4/2013 | Ishii et al. | |
| 2013/0172116 | A1 | 7/2013 | Shigemitsu | |
| 2013/0267348 | A1 * | 10/2013 | Loper | A63B 37/0031 473/376 |
| 2014/0113746 | A1 * | 4/2014 | Sullivan | A63B 37/0043 473/373 |

FOREIGN PATENT DOCUMENTS

| | | | |
|---|---|---|---|
| JP | 2001-37914 | A | 2/2001 |
| JP | 2002-282392 | A | 10/2002 |
| JP | 2005-152396 | A | 6/2005 |
| JP | 2007-622 | A | 1/2007 |
| JP | 2007-130473 | A | 5/2007 |
| JP | 2008-264554 | A | 11/2008 |
| JP | 2009-165824 | A | 7/2009 |
| JP | 2011-78774 | A | 4/2011 |
| JP | 2011-78775 | A | 4/2011 |
| JP | 2011-78776 | A | 4/2011 |
| JP | 2011-87958 | A | 5/2011 |
| KR | 10-2011-0095828 | A | 8/2011 |

OTHER PUBLICATIONS

English translation of First Notification of Office Action issued Feb. 3, 2016, in Chinese Patent Application No. 201410293132.8.

Office Action issued Oct. 21, 2015, in Korean Patent Application No. 10-2014-0077984, with English translation.

English translation of Notice of Final Rejection issued Apr. 27, 2016, in Korean Patent Application No. 10-2014-0077984.

English translation of Second Notification of Office Action issued Sep. 7, 2016, in Chinese Patent Application No. 201410293132.8.

English translation of Notice of Reasons for Rejection mailed Feb. 21, 2017, in Japanese Patent Application No. 2013-133805.

English translation of Notice of Reasons for Rejection mailed Feb. 21, 2017, in Japanese Patent Application No. 2013-133807.

English translation translation of Third Notification of Office Action issued Feb. 22, 2017, in Chinese Patent Application No. 201410293132.8.

* cited by examiner

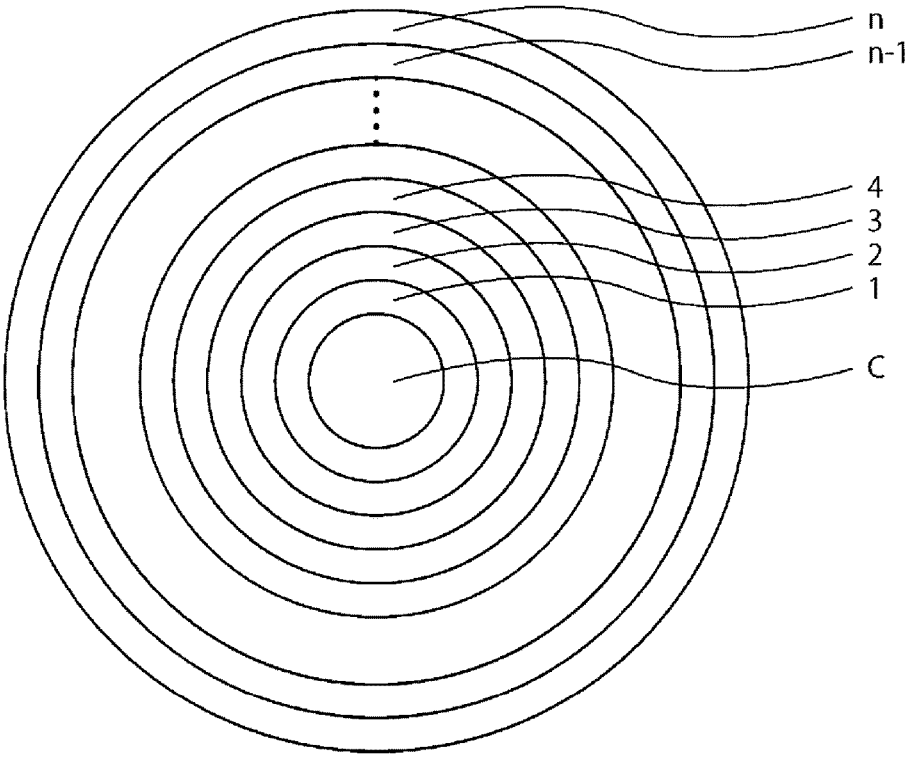
n
n-1
4
3
2
1
C

MULTI-PIECE GOLF BALL

FIELD OF THE INVENTION

The present invention relates to a multi-piece golf ball, in particular, a multi-piece golf ball comprising a center formed from a thermoplastic resin composition.

DESCRIPTION OF THE RELATED ART

Conventionally, a cured material of a rubber composition has been used for a core or center of a golf ball. Recently, molding a core or a center from an injection-moldable thermoplastic resin has been studied.

For example, Japanese Patent Publication No. 2007-130473 A discloses a golf ball comprising at least one layer produced from a polymer composition, wherein the polymer composition has a moisture vapor transmission rate (MVTR) of 8 g-mil/100 $in^2$/day or lower, and the polymer composition has a highly neutralized acid polymer.

Japanese Patent Publication No. 2008-264554 A discloses a golf ball comprising: (a) an inner core layer produced from a first HNP (highly neutralized acid polymer) composition, wherein the first HNP composition has a Shore D hardness of 55 or less and a highly neutralized ethylene/acrylic (or methacrylic) acid/alkyl acrylate (or alkyl methacrylate) copolymer, (b) an outer core layer produced from a second HNP composition, wherein the second HNP composition has a Shore D hardness of 45 or more and a highly neutralized ethylene/acrylic (or methacrylic) acid copolymer, and (c) a cover; wherein the Shore D hardness of the first HNP composition is lower than the Shore D hardness of the second HNP composition.

Japanese Patent Publication No. 2009-165824 A discloses a golf ball comprising a core having a whole diameter ranging from 3.56 cm (1.40 inches) to 4.22 cm (1.66 inches) and a cover, wherein the core comprises a center having a diameter ranging from 0.318 cm (0.125 inches) to 1.91 cm (0.750 inches), a surface hardness of 70 Shore C or more and a specific gravity ranging from 0.50 g/cc to 1.20 g/cc, and an outer core layer having a surface hardness lower than the surface hardness of the center and a specific gravity substantially identical with the specific gravity of the center.

Japanese Patent Publication No. 2011-87958 A discloses a multi-piece golf ball comprising a center, a cover layer and at least two intermediate layers between the center and the cover layer, wherein combined coefficient of restitution values of each subassembly of the golf ball is smaller than combined coefficient of restitution value of that subassembly plus the next outer layer, the center contains a highly neutralized ethylene-$\alpha,\beta$-unsaturated carboxylic acid thermoplastic copolymer where the 100% of the acid is neutralized by a salt of an organic acid, a cation source, or an appropriate base of the organic acid.

Japanese Patent Publication No. 2001-17575 A discloses a sold golf ball formed as a multi-piece structure having four or more pieces comprising a core, an envelope layer covering the core, an intermediate layer covering the envelope layer and a cover covering the intermediate layer, wherein the core is formed from a material containing a thermoplastic resin or a thermoplastic elastomer as a principle material and has a diameter of 3-18 mm and a Shore D hardness of 15-50, the envelope layer is formed from a material containing a thermoplastic resin or a thermoplastic elastomer as a principle material, and the Shore D hardness on the interface between the envelope layer and the intermediate layer is identical or nearly identical.

Japanese Patent Publication No. 2007-622 A discloses a golf ball material formed by blending the following (A)-(C) components: (A) an ionomer, (B) a resin composition formed from one kind or two or more kinds selected from the group consisting of a diene polymer, a thermoplastic polymer and a thermosetting polymer, and (C) a thermoplastic resin composition having an acid group as essential components.

Japanese Patent Publication No. 2011-78774 A discloses a golf ball material containing (a) an olefin-unsaturated carboxylic acid copolymer and/or an olefin-unsaturated carboxylic acid-unsaturated carboxylic acid ester copolymer having a weight average molecular weight (Mw) of 40,000-80,000 and a ratio of weight average molecular weight (Mw) to number average molecular weight (Mn) of 5.0-8.0, or a metal ion-neutralized product thereof, (b) an olefin-unsaturated carboxylic acid copolymer and/or an olefin-unsaturated carboxylic acid-unsaturated carboxylic acid ester copolymer having a weight average molecular weight (Mw) of 120,000-200,000 and a ratio of weight average molecular weight (Mw) to number average molecular weight (Mn) of 6.0-9.5, or a metal ion-neutralized product thereof, (c) an organic acid or a metal salt thereof, and (d) a basic inorganic metal compound for neutralizing 70 mole % or more of the acid groups in the (a)-(c) components, wherein the resin mixture has a Shore D hardness of 30-50.

Japanese Patent Publication No. 2011-78775 A discloses a golf ball material containing (a) an olefin-unsaturated carboxylic acid copolymer and/or an olefin-unsaturated carboxylic acid-unsaturated carboxylic acid ester copolymer having a weight average molecular weight (Mw) of 120,000-200,000 and a ratio of weight average molecular weight (Mw) to number average molecular weight (Mn) of 4.3-6.6, or a metal ion-neutralized product thereof, (b) an olefin-unsaturated carboxylic acid copolymer and/or an olefin-unsaturated carboxylic acid-unsaturated carboxylic acid ester copolymer having a weight average molecular weight (Mw) of 120,000-200,000 and a ratio of weight average molecular weight (Mw) to number average molecular weight (Mn) of 6.8-9.5, or a metal ion-neutralized product thereof, (c) an organic acid or a metal salt thereof, and (d) a basic inorganic metal compound for neutralizing 70 mole % or more of the acid groups in the (a)-(c) components, wherein the resin mixture has a Shore D hardness of 30-55.

Japanese Patent Publication No. 2011-78776 A discloses a golf ball material containing (a) an olefin-methacrylic acid copolymer and/or an olefin-methacrylic acid-unsaturated carboxylic acid ester copolymer having a weight average molecular weight (Mw) of 120,000-200,000 and a ratio of weight average molecular weight (Mw) to number average molecular weight (Mn) of 4.0-7.0, or a metal ion-neutralized product thereof, (b) an olefin-acrylic acid copolymer and/or an olefin-acrylic acid-unsaturated carboxylic acid ester copolymer having a weight average molecular weight (Mw) of 150,000-220,000 and a ratio of weight average molecular weight (Mw) to number average molecular weight (Mn) of 5.5-8.5, or a metal ion-neutralized product thereof, (c) an organic acid or a metal salt thereof, and (d) a basic inorganic metal compound for neutralizing 70 mole % or more of the acid groups in the (a)-(c) components, wherein the resin mixture has a Shore D hardness of 30-60.

SUMMARY OF THE INVENTION

As described above, molding a core or center from an injection-moldable thermoplastic resin has been studied, but the performance of the resultant golf balls is not sufficient, and a further improvement in the performance is required.

The present invention has been achieved in view of the above problems. An object of the present invention is to provide a golf ball comprising a center molded from a thermoplastic resin composition, showing a low spin rate on iron shots and a high spin rate on approach shots.

The present invention provides a multi-piece golf ball comprising a center and n (n is a natural number of 3 or more) envelope layers covering the center, wherein material hardness of the envelope layers satisfies $H2<H0<Hn-1$; where the envelope layers formed in order from the center side are referred to as a first envelope layer, a second envelope layer, a third envelope layer, a fourth envelope layer, . . . an n−1th envelope layer and an nth envelope layer (the outmost layer), respectively and H0 is a material hardness (Shore D hardness) of the center, and H1, H2, H3, H4, . . . Hn−1 and Hn are material hardness (Shore D hardness) of the first envelope layer, the second envelope layer, the third envelope layer, the fourth envelope layer, . . . the n−1th envelope layer and the nth envelope layer (the outmost layer), respectively; and the center is formed from a thermoplastic resin composition, and the second envelope layer is formed from a thermoplastic resin composition or a rubber composition.

The multi-piece golf ball of the present invention is configured as described above and thus has an appropriate hardness distribution, which decreases the spin rate on iron shots, and increases the spin rate on approach shots.

The present invention provides a multi-piece golf ball comprising a center molded from a thermoplastic resin composition, showing a low spin rate on iron shots and a high spin rate on approach shots.

BRIEF DESCRIPTION OF THE DRAWINGS

The FIGURE is a schematic sectional view showing the structure of the golf ball of the present invention.

DESCRIPTION OF THE PREFERRED EMBODIMENT

The present invention provides a multi-piece golf ball comprising a center and n (n is a natural number of 3 or more) envelope layers covering the center, wherein material hardness of the envelope layers satisfies $H2<H0<Hn-1$; where the envelope layers formed in order from the center side are referred to as a first envelope layer, a second envelope layer, a third envelope layer, a fourth envelope layer, . . . an n−1th envelope layer and an nth envelope layer (the outmost layer), respectively and H0 is a material hardness (Shore D hardness) of the center, and H1, H2, H3, H4, . . . Hn−1 and Hn are material hardness (Shore D hardness) of the first envelope layer, the second envelope layer, the third envelope layer, the fourth envelope layer, . . . the n−1th envelope layer and the nth envelope layer (the outmost layer), respectively; and the center is formed from a thermoplastic resin composition, and the second envelope layer is formed from a thermoplastic resin composition or a rubber composition.

(1) Golf Ball Construction

In the follows, the present invention will be described with reference to the drawings. The FIGURE is a sectional view schematically showing the construction of the multi-piece golf ball of the present invention. The multi-piece golf ball of the present invention comprises a center C and n envelope layers (n is a natural number of 3 or more) covering the center. Herein, the envelope layers formed in order from the center side are referred to as a first envelope layer 1, a second envelope layer 2, a third envelope layer 3, a fourth envelope layer 4, . . . an n−1th envelope layer n−1 and an nth envelope layer n, and H1, H2, H3, H4, . . . Hn−1 and Hn are material hardness (Shore D hardness) of the first envelope layer 1, the second envelope layer 2, the third envelope layer 3, the fourth envelope layer 4, . . . the n−1th envelope layer n−1 and the nth envelope layer. The nth envelope layer is the outmost layer. The n is a natural number of 3 or more, preferably a natural number of 4 or more, and is preferably a natural number of 10 or less, more preferably a natural number of 9 or less. If the number of the envelope layers is 3 or more, it becomes easy to provide an appropriate hardness distribution to the envelope layers. On the other hand, if the number of the envelope layers is excessively large, the moldability of the envelope layers becomes low. It is noted that a paint film and a reinforcement layer (adhesive agent layer) that is provided to improve adhesion between the envelope layers are not included in the envelope layers. The paint film and the reinforcement layer (adhesive agent layer) have a different film thickness range from the envelope layers. The paint film and the reinforcement layer (adhesive agent layer) generally have a film thickness of 50 μm or less.

In the multi-piece golf ball of the present invention, the second envelope layer has a material hardness H2 (Shore D hardness) which is lower than the material hardness H0 (Shore D hardness) of the center. The hardness difference (H0−H2) between the material hardness H2 of the second envelope layer and the material hardness H0 of the center is preferably 1 or more, more preferably 2 or more, even more preferably 4 or more, and is preferably 57 or less, more preferably 53 or less, even more preferably 50 or less in Shore D hardness. If the hardness difference (H0−H2) between the material hardness H2 of the second envelope layer and the material hardness H0 of the center is within the above range, the spin rate on iron shots is further lowered.

In the multi-piece golf ball of the present invention, the n−1th envelope layer has a material hardness Hn−1 (Shore D hardness) which is larger than the material hardness H0 (Shore D hardness) of the center. The hardness difference ((Hn−1)−H0) between the material hardness Hn−1 of the n−1th envelope layer and the material hardness H0 of the center is preferably 5 or more, more preferably 7 or more, even more preferably 10 or more, and is preferably 75 or less, more preferably 70 or less, even more preferably 65 or less in Shore D hardness. If the hardness difference ((Hn−1)−H0) between the material hardness Hn−1 of the n−1th envelope layer and the material hardness H0 of the center is within the above range, the golf ball becomes an outer-hard and inner-soft structure, thus the spin rate on iron shots thereof is further lowered.

The material hardness H0 of the center is preferably 5 or more, more preferably 6 or more, even more preferably 7 or more in Shore D hardness. If the material hardness of the center is lower than 5 in Shore D hardness, the center becomes so soft that the resilience of the golf ball may be lowered. In addition, the material hardness of the center is preferably 60 or less, more preferably 45 or less, even more preferably 30 or less in Shore D hardness. If the material hardness exceeds 60 in Shore D hardness, the center becomes so hard that the shot feeling of the golf ball tends to be lowered. In the present invention, the material hardness H0 of the center is a slab hardness obtained by measuring the hardness of the thermoplastic resin composition constituting the center and molded in a sheet shape.

The material hardness H1 of the first envelope layer is preferably 3 or more, more preferably 4 or more, even more preferably 5 or more, and is preferably 45 or less, more preferably 40 or less, even more preferably 35 or less, most preferably 30 or less in Shore D hardness. If the material hardness H1 of the first envelope layer is within the above range, the spin rate on iron shots is further lowered.

The first envelope layer has a material hardness H1 (Shore D hardness) which is lower than the material hardness H0 (Shore D hardness) of the center. The hardness difference (H0−H1) between the material hardness H1 of the first envelope layer and the material hardness H0 of the center is preferably 1 or more, more preferably 2 or more, even more preferably 3 or more, and is preferably 40 or less, more preferably 35 or less, even more preferably 30 or less in Shore D hardness. If the hardness difference (H0−H1) between the material hardness H1 of the first envelope layer and the material hardness H0 of the center is within the above range, the spin rate on iron shots is further lowered.

The material hardness H2 of the second envelope layer is preferably 3 or more, more preferably 4 or more, even more preferably 5 or more, and is preferably 40 or less, more preferably 35 or less, even more preferably 30 or less, most preferably 25 or less in Shore D hardness. If the material hardness H2 of the second envelope layer is within the above range, the spin rate on iron shots is further lowered.

The material hardness Hn−1 of the n−1th envelope layer is preferably 45 or more, more preferably 47 or more, even more preferably 50 or more, and is preferably 80 or less, more preferably 77 or less, even more preferably 75 or less in Shore D hardness. If the material hardness Hn−1 of the n−1th envelope layer is within the above range, the golf ball becomes an outer-hard and inner-soft structure, thus the spin rate on iron shots thereof is further lowered.

The hardness difference ((Hn−1)−H2) between the material hardness Hn−1 of the n−1th envelope layer and the material hardness H2 of the second envelope layer is preferably 5 or more, more preferably 10 or more, even more preferably 15 or more, and is preferably 77 or less, more preferably 70 or less, even more preferably 65 or less in Shore D hardness. If the hardness difference ((Hn−1)−H2) between the material hardness Hn−1 of the n−1th envelope layer and the material hardness H2 of the second envelope layer is within the above range, the spin rate on iron shots is further lowered.

The material hardness Hn of the nth envelope layer (the outmost layer) is preferably 5 or more, more preferably 7 or more, even more preferably 10 or more, and is preferably 55 or less, more preferably 53 or less, even more preferably 50 or less in Shore D hardness. If the material hardness Hn of the nth envelope layer is within the above range, the spin rate on approach shots increases.

The material hardness of the first envelope layer to the n−1th envelope layer in Shore D hardness preferably satisfies the following Equation (1).

$$H2<H1,H3,H4,Hn-3,Hn-2,Hn-1 \quad (1)$$

That is, in the multi-piece golf ball of the present invention, the material hardness H2 of the second envelope layer is preferably lowest. By making the material hardness H2 of the second envelope layer lowest, the spin rate on iron shots is further lowered.

The material hardness of the first envelope layer to the n−1th envelope layer in Shore D hardness preferably satisfies the following Equation (2).

$$H1>H2<H3<H4< \ldots <Hn-3<Hn-2<Hn-1 \quad (2)$$

If the material hardness of the second envelope layer to the n−1th envelope layer satisfies the above equation, the golf ball becomes an outer-hard and inner-soft structure, thus the golf ball showing a low spin rate on iron shots can be obtained. The golf ball showing a low spin rate on iron shots travels a great distance.

For the spherical bodies where the envelope layers are formed in order from the center side, surface hardness of the envelope layers preferably satisfies the following Equation (3).

$$S1>S2<S3<S4< \ldots <Sn-3<Sn-2<Sn-1 \quad (3)$$

Herein, S1, S2, S3, S4, . . . and, Sn−1 are surface hardness (Shore D hardness) of the first envelope layer, the second envelope layer, the third envelope layer, the fourth envelope layer, . . . the n−1th envelope layer, respectively. If the surface hardness (Shore D hardness) of the first envelope layer to the n−1th envelope layer satisfies the above equation, the golf ball becomes an outer-hard and inner-soft structure, the golf ball showing a low spin rate on iron shots can be obtained. The golf ball showing a low spin rate on iron shots travels a great distance.

The diameter of the center is preferably 5 mm or more, more preferably 7 mm or more, even more preferably 10 mm or more, and is preferably 25 mm or less, more preferably 22 mm or less, even more preferably 20 mm or less. If the diameter of the center is 5 mm or more, the spin rate on iron shots is further lowered. On the other hand, if the diameter of the center is 25 mm or less, the spin rate on approach shots is hard to be lowered.

When the center has a diameter from 5 mm to 25 mm, a compression deformation amount (shrinking amount of the center along the compression direction) of the center when applying a load from an initial load of 98N to a final load of 1275N to the center is preferably 1.5 mm or more, more preferably 1.7 mm or more, even more preferably 2.0 mm or more, and is preferably 5.0 mm or less, more preferably 4.7 mm or less, even more preferably 4.5 mm or less. If the compression deformation amount is 1.5 mm or more, the shot feeling of the golf ball becomes better, while if the compression deformation amount is 5.0 mm or less, the resilience of the golf ball becomes better.

The thickness of each layer from the first envelope layer to the n−1th envelope layer is not particularly limited, but is preferably 0.1 mm or more, more preferably 0.2 mm or more, even more preferably 0.3 mm or more, and is preferably 15 mm or less, more preferably 13 mm or less, even more preferably 10 mm or less.

The thickness of the nth envelope layer (the outmost layer) is preferably 2.0 mm or less, more preferably 1.6 mm or less, even more preferably 1.2 mm or less, most preferably 1.0 mm or less. If the thickness of the nth envelope layer (the outmost layer) is 2.0 mm or less, the resilience and the shot feeling of the obtained golf ball becomes better. The thickness of the nth envelope layer (the outmost layer) is preferably 0.1 mm or more, more preferably 0.2 mm or more, even more preferably 0.3 mm or more. If the thickness of the nth envelope layer (the outmost layer) is less than 0.1 mm, molding the nth envelope layer (the outmost layer) may become difficult, and the durability and the abrasion resistance of the nth envelope layer (the outmost layer) may be lowered.

When the multi-piece golf ball of the present invention has a diameter from 40 mm to 45 mm, a compression deformation amount (shrinking amount along the compression direction) of the golf ball when applying a load from 98 N as an initial load to 1275 N as a final load to the golf ball is preferably 2.0 mm or more, more preferably 2.2 mm or more, and is preferably 4.0 mm or less, more preferably 3.5 mm or less. If the golf ball has a compression deformation amount of 2.0 mm or more, the golf ball does not become excessively hard, thus the shot feeling thereof is better. On the other hand, if the compression deformation amount is 4.0 mm or less, the resilience becomes better.

Specific examples of the multi-piece golf ball of the present invention include a six-piece golf ball, a seven-piece golf ball and the like.

(2) Materials

In the multi-piece golf ball of the present invention, the center is formed from a thermoplastic resin composition, and the second envelope layer is formed from a thermoplastic resin composition or a rubber composition. The first envelope layer, and the third envelope layer to the nth envelope layer may be formed from any one of the thermoplastic resin composition and the rubber composition, but are preferably formed from the thermoplastic resin composition. This is because molding the first envelope layer and the third envelope layer to the nth envelope layer becomes easy.

First, the thermoplastic resin composition used in the present invention will be explained. (A) The resin component contained in the thermoplastic resin composition is not particularly limited, as long as it is a thermoplastic resin. Examples of the thermoplastic resin include, for example, a thermoplastic resin such as an ionomer resin, a thermoplastic olefin copolymer, a thermoplastic polyurethane resin, a thermoplastic polyamide resin, a thermoplastic styrene-based resin, a thermoplastic polyester resin, a thermoplastic acrylic resin, and the like. Among these thermoplastic resins, a thermoplastic elastomer having rubber elasticity is preferable. Examples of the thermoplastic elastomer include, for example, a thermoplastic polyurethane elastomer, a thermoplastic polyamide elastomer, a thermoplastic styrene-based elastomer, a thermoplastic polyester elastomer, a thermoplastic acrylic-based elastomer, and the like.

(2-1) Ionomer Resin

Examples of the ionomer resin include: an ionomer resin consisting of a metal ion-neutralized product of a binary copolymer composed of an olefin and an α,β-unsaturated carboxylic acid having 3 to 8 carbon atoms; an ionomer resin consisting of a metal ion-neutralized product of a ternary copolymer composed of an olefin, an α,β-unsaturated carboxylic acid having 3 to 8 carbon atoms and an α,β-unsaturated carboxylic acid ester; or a mixture thereof.

In the present invention, "the ionomer resin consisting of a metal ion-neutralized product of a binary copolymer composed of an olefin and an α,β-unsaturated carboxylic acid having 3 to 8 carbon atoms" is sometimes merely referred to as "the binary ionomer resin", and "the ionomer resin consisting of a metal ion-neutralized product of a ternary copolymer composed of an olefin, an α,β-unsaturated carboxylic acid having 3 to 8 carbon atoms and an α,β-unsaturated carboxylic acid ester" is sometimes merely referred to as "the ternary ionomer resin".

The olefin is preferably an olefin having 2 to 8 carbon atoms. Examples of the olefin include, for example, ethylene, propylene, butene, pentene, hexene, heptane and octane, and ethylene is particularly preferred. Examples of the α,β-unsaturated carboxylic acid having 3 to 8 carbon atoms include, for example, acrylic acid, methacrylic acid, fumaric acid, maleic acid and crotonic acid, and acrylic acid and methacrylic acid are particularly preferred. In addition, examples of the α,β-unsaturated carboxylic acid ester include, for example, methyl ester, ethyl ester, propyl ester, n-butyl ester, isobutyl ester of acrylic acid, methacrylic acid, fumaric acid and maleic acid, and acrylic acid ester and methacrylic acid ester are particularly preferred.

The binary ionomer resin is preferably a metal ion-neutralized product of a binary copolymer composed of ethylene-(meth)acrylic acid. The ternary ionomer resin is preferably a metal ion-neutralized product of a ternary copolymer composed of ethylene, (meth)acrylic acid and (meth)acrylic acid ester. Here, (meth)acrylic acid means acrylic acid and/or methacrylic acid.

The content of the α,β-unsaturated carboxylic acid component having 3 to 8 carbon atoms in the binary ionomer resin is preferably 15 mass % or more, more preferably 16 mass % or more, and even more preferably 17 mass % or more, and is preferably 30 mass % or less, more preferably 25 mass % or less. If the content of the α,β-unsaturated carboxylic acid component having 3 to 8 carbon atoms is 15 mass % or more, the resultant constituent member has a desirable hardness. If the content of the α,β-unsaturated carboxylic acid component having 3 to 8 carbon atoms is 30 mass % or less, since the hardness of the resultant constituent member does not become excessively high, the durability and the shot feeling thereof become better.

The degree of neutralization of the carboxyl groups of the binary ionomer resin is preferably 15 mole % or more, more preferably 20 mole % or more, and is preferably 100 mole % or less. If the degree of neutralization is 15 mole % or more, the resultant golf ball has better resilience and durability. The degree of neutralization of the carboxyl groups of the binary ionomer resin can be calculated by the following expression. Sometimes, the metal component is contained in such an amount that the theoretical degree of neutralization of the carboxyl groups contained in the ionomer resin exceeds 100 mole %.

Degree of neutralization (mole %) of the binary ionomer resin=100×the number of moles of carboxyl groups neutralized in the binary ionomer resin/the number of moles of all carboxyl groups contained in the binary ionomer resin Examples of the metal ion used for neutralizing at least a part of carboxyl groups of the binary ionomer resin include: a monovalent metal ion such as sodium, potassium, lithium; a divalent metal ion such as magnesium, calcium, zinc, barium, cadmium; a trivalent metal ion such as aluminum; and other ion such as tin, zirconium.

Specific examples of the binary ionomer resin include trade name "Himilan (registered trademark) (e.g. Himilan 1555 (Na), Himilan 1557 (Zn), Himilan 1605 (Na), Himilan 1706 (Zn), Himilan 1707 (Na), Himilan AM7311 (Mg), Himilan AM7329 (Zn))" commercially available from Mitsui-Du Pont Polychemicals Co., Ltd.

Further, examples include "Surlyn (registered trademark) (e.g. Surlyn 8945 (Na), Surlyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li), Surlyn AD8546 (Li))" commercially available from E.I. du Pont de Nemours and Company.

Further, examples include "Iotek (registered trademark) (e.g. Iotek 8000 (Na), Iotek 8030 (Na), Iotek 7010 (Zn), Iotek 7030 (Zn))" commercially available from ExxonMobil Chemical Corporation.

The binary ionomer resins may be used alone or as a mixture of at least two of them. It is noted that Na, Zn, Li and Mg described in the parentheses after the trade names indicate metal types of neutralizing metal ions of the binary ionomer resins.

The binary ionomer resin preferably has a bending stiffness of 140 MPa or more, more preferably 150 MPa or more, and even more preferably 160 MPa or more, and preferably has a bending stiffness of 550 MPa or less, more preferably 500 MPa or less, even more preferably 450 MPa or less. If the bending stiffness of the binary ionomer resin is excessively low, the flight distance tends to be shorter because of the increased spin rate of the golf ball. If the bending stiffness is excessively high, the durability of the golf ball may be lowered.

The binary ionomer resin preferably has a melt flow rate (190° C., 2.16 kgf) of 0.1 g/10 min or more, more preferably 0.5 g/10 min or more, even more preferably 1.0 g/10 min or more, and preferably has a melt flow rate (190° C., 2.16 kgf) of 30 g/10 min or less, more preferably 20 g/10 min or less, even more preferably 15 g/10 min or less. If the melt flow rate (190° C., 2.16 kgf) of the binary ionomer resin is 0.1 g/10 min or more, the thermoplastic resin composition has better fluidity, thus, for example, molding a thin layer becomes possible. If the melt flow rate (190° C., 2.16 kgf) of the binary ionomer resin is 30 g/10 min or less, the durability of the resultant golf ball becomes better.

The content of the α,β-unsaturated carboxylic acid component having 3 to 8 carbon atoms in the ternary ionomer resin is preferably 2 mass % or more, more preferably 3 mass % or more, and is preferably 30 mass % or less, more preferably 25 mass % or less.

The degree of neutralization of the carboxyl groups of the ternary ionomer resin is preferably 20 mole % or more, more preferably 30 mole % or more, and is preferably 100 mole % or less. If the degree of neutralization is 20 mole % or more, the resultant golf ball using the thermoplastic resin composition has better resilience and durability. The degree of neutralization of the carboxyl groups of the ionomer resin can be calculated by the following expression. Sometimes, the metal component is contained in such an amount that the theoretical degree of neutralization of the carboxyl groups of the ionomer resin exceeds 100 mole %.

Degree of neutralization (mole %) of the ionomer resin=100×the number of moles of carboxyl groups neutralized in the ionomer resin/the number of moles of all carboxyl groups contained in the ionomer resin Examples of the metal ion used for neutralizing at least a part of carboxyl groups of the ternary ionomer resin include: a monovalent metal ion such as sodium, potassium, lithium; a divalent metal ion such as magnesium, calcium, zinc, barium, cadmium; a trivalent metal ion such as aluminum; and other ion such as tin, zirconium.

Specific examples of the ternary ionomer resin include trade name "Himilan (registered trademark) (e.g. Himilan AM7327 (Zn), Himilan 1855 (Zn), Himilan 1856 (Na), Himilan AM7331 (Na))" commercially available from Mitsui-Du Pont Polychemicals Co., Ltd. Further, the ternary ionomer resins commercially available from E.I. du Pont de Nemours and Company include "Surlyn 6320 (Mg), Surlyn 8120 (Na), Surlyn 8320 (Na), Surlyn 9320 (Zn), Surlyn 9320W (Zn), HPF1000 (Mg), HPF2000 (Mg) or the like". The ternary ionomer resins commercially available from ExxonMobil Chemical Corporation include "Iotek 7510 (Zn), Iotek 7520 (Zn) or the like". It is noted that Na, Zn and Mg described in the parentheses after the trade names indicate metal types of neutralizing metal ions. The ternary ionomer resins may be used alone or as a mixture of at least two of them.

The ternary ionomer resin preferably has a bending stiffness of 10 MPa or more, more preferably 11 MPa or more, even more preferably 12 MPa or more, and preferably has a bending stiffness of 100 MPa or less, more preferably 97 MPa or less, even more preferably 95 MPa or less. If the bending stiffness of the ternary ionomer resin is excessively low, the flight distance tends to be shorter because of the increased spin rate of the golf ball. If the bending stiffness is excessively high, the durability of the golf ball may be lowered.

The ternary ionomer resin preferably has a melt flow rate (190° C., 2.16 kgf) of 0.1 g/10 min or more, more preferably 0.3 g/10 min or more, even more preferably 0.5 g/10 min or more, and preferably has a melt flow rate (190° C., 2.16 kgf) of 20 g/10 min or less, more preferably 15 g/10 min or less, even more preferably 10 g/10 min or less. If the melt flow rate (190° C., 2.16 kgf) of the ternary ionomer resin is 0.1 g/10 min or more, the thermoplastic resin composition has better fluidity, thus it is easy to mold a thin envelope layer. If the melt flow rate (190° C., 2.16 kgf) of the ternary ionomer resin is 20 g/10 min or less, the durability of the resultant golf ball becomes better.

The ternary ionomer resin preferably has a slab hardness of 20 or more, more preferably 25 or more, even more preferably 30 or more, and preferably has a slab hardness of 70 or less, more preferably 65 or less, even more preferably 60 or less in Shore D hardness. If the ternary ionomer resin has a slab hardness of 20 or more in Shore D hardness, the resultant constituent member does not become excessively soft and thus the golf ball has better resilience. If the ternary ionomer resin has a slab hardness of 70 or less in Shore D hardness, the resultant constituent member does not become excessively hard and thus the golf ball has better durability.

(2-2) Thermoplastic Olefin Copolymer

Examples of the thermoplastic olefin copolymer include, for example, a binary copolymer composed of an olefin and an α,β-unsaturated carboxylic acid having 3 to 8 carbon atoms; a ternary copolymer composed of an olefin, an α,β-unsaturated carboxylic acid having 3 to 8 carbon atoms, and an α,β-unsaturated carboxylic acid ester; or a mixture thereof. The thermoplastic olefin copolymer is a nonionic copolymer in which the carboxyl groups are not neutralized.

In the present invention, "the binary copolymer composed of an olefin and an α,β-unsaturated carboxylic acid having 3 to 8 carbon atoms" is sometimes merely referred to as "the binary copolymer", and "the ternary copolymer composed of an olefin, an α,β-unsaturated carboxylic acid having 3 to 8 carbon atoms, and an α,β-unsaturated carboxylic acid ester" is sometimes merely referred to as "the ternary copolymer".

Examples of the olefin include those exemplified in the olefin constituting the ionomer resin, and ethylene is particularly preferred. Examples of the α,β-unsaturated carboxylic acid having 3 to 8 carbon atoms and the ester thereof include those exemplified in the α,β-unsaturated carboxylic acid having 3 to 8 carbon atoms and the ester thereof constituting the ionomer resin.

The binary copolymer is preferably a binary copolymer composed of ethylene and (meth)acrylic acid. The ternary copolymer is preferably a ternary copolymer composed of ethylene, (meth)acrylic acid, and (meth)acrylic acid ester. Herein, (meth)acrylic acid means acrylic acid and/or methacrylic acid.

The content of the α,β-unsaturated carboxylic acid having 3 to 8 carbon atoms in the binary copolymer or the ternary copolymer is preferably 4 mass % or more, more preferably 5 mass % or more, and is preferably 30 mass % or less, more preferably 25 mass % or less.

The binary copolymer or the ternary copolymer preferably has a melt flow rate (190° C., 2.16 kgf) of 5 g/10 min or more, more preferably 10 g/10 min or more, even more preferably 15 g/10 min or more, and preferably has a melt flow rate (190° C., 2.16 kgf) of 1,700 g/10 min or less, more preferably 1,500 g/10 min or less, even more preferably 1,300 g/10 min or less. If the melt flow rate (190° C., 2.16 kgf) of the binary copolymer or the ternary copolymer is 5 g/10 min or more, the thermoplastic resin composition has better fluidity and thus it is easy to mold a constituent member. If the melt flow rate (190° C., 2.16 kgf) of the binary copolymer or the ternary copolymer is 1,700 g/10 min or less, the resultant golf ball has better durability.

Specific examples of the binary copolymer include: an ethylene-methacrylic acid copolymer having a trade name of "NUCREL (registered trademark) (e.g. "NUCREL N1050H", "NUCRE LN2050H", "NUCREL N1110H", "NUCREL NO200H")" commercially available from Mitsui-Du Pont Polychemicals Co., Ltd; an ethylene-acrylic acid copolymer having a trade name of "PRIMACOR (registered trademark) 59801" commercially available from Dow Chemical Company; and the like.

Specific examples of the ternary copolymer include: the ternary copolymer having a trade name of "NUCREL (registered trademark) (e.g. "NUCREL AN4318", "NUCREL AN4319")" commercially available from Mitsui-Du Pont Polychemicals Co., Ltd; the ternary copolymer having a trade name of "NUCREL (registered trademark) (e.g. "NUCREL AE")" commercially available from E.I. du Pont de Nemours and Company; the ternary copolymer having a trade name of "PRIMACOR (registered trademark) (e.g. "PRIMACOR AT310", "PRIMACOR AT320")" commercially available from Dow Chemical Company; and the like. The binary copolymer or the ternary copolymer may be used alone or as a mixture of at least two of them.

(2-3) Thermoplastic Polyurethane Resin and Thermoplastic Polyurethane Elastomer

Examples of the thermoplastic polyurethane resin and the thermoplastic polyurethane elastomer include a thermoplastic resin and a thermoplastic elastomer which have plurality of urethane bonds in the main molecular chain. The polyurethane is preferably a product obtained by a reaction between a polyisocyanate component and a polyol component. Examples of the thermoplastic polyurethane elastomer include, for example, the thermoplastic polyurethane elastomers having trade names of "Elastollan XNY85A", "Elastollan XNY90A", "Elastollan XNY97A", "Elastollan ET885", and "Elastollan ET890" manufactured by BASF Japan Ltd and the like.

(2-4) Thermoplastic Styrene-Based Elastomer

A thermoplastic elastomer containing a styrene block can be appropriately used as the thermoplastic styrene-based elastomer. The thermoplastic elastomer containing a styrene block has a polystyrene block which is a hard segment, and a soft segment. Typical soft segment is a diene block. Examples of a constituent component of the diene block include butadiene, isoprene, 1,3-pentadiene and 2,3-dimethyl-1,3-butadiene. Butadiene and isoprene are preferable. Two or more constituent components may be combined.

The thermoplastic elastomer containing a styrene block includes: a styrene-butadiene-styrene block copolymer (SBS), a styrene-isoprene-styrene block copolymer (SIS), a styrene-isoprene-butadiene-styrene block copolymer (SIBS), a hydrogenated product of SBS, a hydrogenated product of SIS and a hydrogenated product of SIBS. Examples of the hydrogenated product of SBS include a styrene-ethylene-butylene-styrene block copolymer (SEBS). Examples of the hydrogenated product of SIS include a styrene-ethylene-propylene-styrene block copolymer (SEPS). Examples of the hydrogenated product of SIBS include a styrene-ethylene-ethylene-propylene-styrene block copolymer (SEEPS).

The content of the styrene component in the thermoplastic elastomer containing a styrene block is preferably 10 mass % or more, more preferably 12 mass % or more, even more preferably 15 mass % or more. In the view of the shot feeling of the resultant golf ball, the content is preferably 50 mass % or less, more preferably 47 mass % or less, even more preferably 45 mass % or less.

The thermoplastic elastomer containing a styrene block includes an alloy of a polyolefin with one kind or two or more kinds selected from the group consisting of SBS, SIS, SIBS, SEBS, SEPS, SEEPS and hydrogenated products thereof. It is inferred that the olefin component in the alloy contributes to the improvement of compatibility with the ionomer resin. By using the alloy, the resilience performance of the golf ball is improved. An olefin having 2 to 10 carbon atoms is preferably used. Appropriate examples of the olefin include ethylene, propylene, butane and pentene. Ethylene and propylene are particularly preferred.

Specific examples of the polymer alloy include the polymer alloys having trade names of "Rabalon T3221C", "Rabalon T33390", "Rabalon SJ4400N", "Rabalon SJ5400N", "Rabalon SJ6400N", "Rabalon SJ7400N", "Rabalon SJ8400N", "Rabalon SJ9400N" and "Rabalon SR04" manufactured by Mitsubishi Chemical Corporation. Other specific examples of the thermoplastic elastomer containing a styrene block include "Epofriend A1010" manufactured by Daicel Chemical Industries, Ltd and "Septon HG-252" manufactured by Kuraray Co., Ltd.

(2-5) Thermoplastic Polyamide Resin and Thermoplastic Polyamide Elastomer

The thermoplastic polyamide is not particularly limited, as long as it is a thermoplastic resin having plurality of amide bonds (—NH—CO—) in the main molecular chain. Examples of the thermoplastic polyamide include, for example, a product having amide bonds formed in the molecule by a ring-opening polymerization of lactam or a reaction between a diamine component and a dicarboxylic acid component.

Examples of the polyamide resin include, for example, an aliphatic polyamide such as polyamide 6, polyamide 11, polyamide 12, polyamide 66, polyamide 610, polyamide 6T, polyamide 6I, polyamide 9T, polyamide MST, polyamide 612; and an aromatic polyamide such as poly-p-phenyleneterephthalamide, poly-m-phenyleneisophthalamide. These polyamides may be used alone or in combination of at least two of them. Among them, the aliphatic polyamide such as polyamide 6, polyamide 66, polyamide 11, polyamide 12 is appropriate.

Specific examples of the polyamide resin include, for example, the polyamide resin having a trade name of "Rilsan (registered trademark) B (e.g. Rilsan BESN TL, Rilsan BESN P20 TL, Rilsan BESN P40 TL, Rilsan MB3610, Rilsan BMF O, Rilsan BMN O, Rilsan BMN O TLD, Rilsan BMN BK TLD, Rilsan BMN P20 D, Rilsan BMN P40 D and the like)" commercially available from Arkema Inc., and the like.

The polyamide elastomer has a hard segment part consisting of a polyamide component and a soft segment part. Examples of the soft segment part of the polyamide elastomer include, for example, a polyether ester component or a polyether component. Examples of the polyamide elastomer include, for example, a polyether ester amide obtained by a reaction between a polyamide component (hard segment component) and a polyether ester component (soft segment component) consisting of polyoxyalkylene glycol and dicarboxylic acid; and a polyether amide obtained by a reaction between a polyamide component (hard segment component) and a polyether (soft segment component) consisting of a product obtained by aminating or carboxylating two terminal ends of polyoxyalkylene glycol and dicarboxylic acid or diamine.

Examples of the polyamide elastomer include, for example, "Pebax 2533", "Pebax 3533", "Pebax 4033", "Pebax 5533" manufactured by Arkema Inc. and the like.

(2-6) Thermoplastic Polyester Resin and Thermoplastic Polyester Elastomer

The thermoplastic polyester resin is not particularly limited, as long as it is a thermoplastic resin having plurality of ester bonds in the main molecular chain. For example, a product obtained by a reaction between dicarboxylic acid and diol is preferable. Examples of the thermoplastic polyester elastomer include, for example, a block copolymer having a hard segment consisting of a polyester component and a soft segment. Examples of the polyester component constituting the hard segment include, for example, an aromatic polyester. Examples of the soft segment component include an aliphatic polyether, an aliphatic polyester and the like.

Specific examples of the polyester elastomer include "Hytrel 3548", "Hytrel 4047" manufactured by Toray-Du Pont Co., Ltd; "Primalloy A1606", "Primalloy B1600", "Primalloy B1700" manufactured by Mitsubishi Chemical Corporation; and the like.

(2-7) Thermoplastic (Meth)acrylic-Based Elastomer

Examples of the thermoplastic (meth)acrylic-based elastomer include a thermoplastic elastomer obtained by copolymerizing ethylene and (meth)acrylic acid ester. Specific examples of the thermoplastic (meth)acrylic-based elastomer include, for example, "Kurarity (a block copolymer of methyl methacrylate and butyl acrylate)" manufactured by Kuraray Co., Ltd.

The thermoplastic resin composition preferably contains, as the resin component, at least one kind selected from the group consisting of the ionomer resin, the thermoplastic olefin copolymer, the thermoplastic styrene-based elastomer, the thermoplastic polyester elastomer, the thermoplastic polyurethane elastomer, the thermoplastic polyamide elastomer, and the thermoplastic acrylic-based elastomer. This is because a constituent member having a desired hardness can be formed easily.

In the present invention, when the ionomer resin or the thermoplastic olefin copolymer are used as the resin component contained in the thermoplastic resin composition, the thermoplastic resin composition may further contain (B) a basic metal salt of a fatty acid which will be explained below. By containing (B) the basic metal salt of the fatty acid, the degree of neutralization of the ionomer resin and the thermoplastic olefin copolymer can be increased. By increasing the degree of neutralization, the resilience of the resultant constituent member becomes higher.

(B) The basic metal salt of the fatty acid is obtained by a well-known producing method where a fatty acid is allowed to react with a metal oxide or metal hydroxide. The conventional metal salt of the fatty acid is obtained by a reaction of the fatty acid with the metal oxide or metal hydroxide in an amount of the reaction equivalent, whereas (B) the basic metal salt of the fatty acid is obtained by adding the metal oxide or metal hydroxide in an excessive amount which is larger than the reaction equivalent to the fatty acid, and the resultant product has a different metal content, melting point or the like from the conventional metal salt of the fatty acid.

As (B) the basic metal salt of the fatty acid, a basic metal salt of a fatty acid represented by the following general formula (4) is preferred.

$$mM^1O.M^2(RCOO)_2 \quad (4)$$

In the formula (4), m represents the number of moles of metal oxides or metal hydroxides in the basic metal salt of the fatty acid. The m preferably ranges from 0.1 to 2.0, and more preferably from 0.2 to 1.5. If m is less than 0.1, the resilience of the obtained resin composition may be lowered, while if m exceeds 2.0, the melting point of the basic metal salt of the fatty acid becomes so high that it may be difficult to disperse to the resin component. $M^1$ and $M^2$ are preferably the group II or the group XII metals of the periodic table, respectively. $M^1$ and $M^2$ may be identical or different from each other. Examples of the group II metals include beryllium, magnesium, calcium, strontium and barium. Examples of the group XII metals include zinc, cadmium and mercury. Preferred is, for example, magnesium, calcium, barium or zinc, and more preferred is magnesium, as $M^1$ and $M^2$ metals.

In the formula (4), RCOO means the residue of the saturated fatty acid or unsaturated fatty acid. Specific examples of the saturated fatty acid component of (B) the basic metal salt of the fatty acid (IUPAC name) include butanoic acid (C4), pentanoic acid (C5), hexanoic acid (C6), heptanoic acid (C7), octanoic acid (C8), nonanoic acid (C9), decanoic acid (010), undecanoic acid (C11), dodecanoic acid (C12), tridecanoic acid (C13), tetradecanoic acid (C14), pentadecanoic acid (C15), hexadecanoic acid (C16), heptadecanoic acid (C17), octadecanoic acid (C18), nonadecanoic acid (C19), icosanoic acid (C20), henicosanoic acid (C21), docosanoic acid (C22), tricosanoic acid (C23), tetracosanoic acid (C24), pentacosanoic acid (C25), hexacosanoic acid (C26), heptacosanoic acid (C27), octacosanoic acid (C28), nonacosanoic acid (C29), and triacontanoic acid (C30).

Specific examples of the unsaturated fatty acid component of (B) the basic metal salt of the fatty acid (IUPAC name) include butenoic acid (C4), pentenoic acid (C5), hexenoic acid (C6), heptenoic acid (C7), octenoic acid (C8), nonenoic acid (C9), decenoic acid (010), undecenoic acid (C11), dodecenoic acid (C12), tridecenoic acid (C13), tetradecenoic acid (C14), pentadecenoic acid (C15), hexadecenoic acid (C16), heptadecenoic acid (C17), octadecenoic acid (C18), nonadecenoic acid (C19), icosenoic acid (C20), henicosenoic acid (C21), docosenoic acid (C22), tricosenoic acid (C23), tetracosenoic acid (C24), pentacosenoic acid (C25), hexacosenoic acid (C26), heptacosenoic acid (C27), octacosenoic acid (C28), nonacosenoic acid (C29), and triacontenoic acid (C30).

Specific examples of the fatty acid component of (B) the basic metal salt of the fatty acid (Common name) are, for example, butyric acid (C4), valeric acid (C5), caproic acid (C6), enanthic acid (C7), caprylic acid (C8), pelargonic acid (C9), capric acid (010), lauric acid (C12), myristic acid (C14), myristoleic acid (C14), pentadecylic acid (C15), palmitic acid (C16), palmitoleic acid (C16), margaric acid (C17), stearic acid (C18), elaidic acid (C18), vaccenic acid (C18), oleic acid (C18), linoleic acid (C18), linolenic acid (C18), 12-hydroxy stearic acid (C18), arachidic acid (C20), gadoleic acid (C20), arachidonic acid (C20), eicosenoic acid (C20), behenic acid (C22), erucic acid (C22), lignoceric acid (C24), nervonic acid (C24), cerotic acid (C26), montanic acid (C28), and melissic acid (C30).

(B) The basic metal salt of the fatty acid is preferably a basic metal salt of an unsaturated fatty acid. The unsaturated fatty acid component preferably includes at least one selected from the group consisting of oleic acid (C18), erucic acid (C22), linoleic acid (C18), linolenic acid (C18), arachidonic acid (C20), eicosapentaenoic acid (C20), docosahexaenoic acid (C22), stearidonic acid (C18), nervonic acid (C24), vaccenic acid (C18), gadoleic acid (C20), elaidic acid (C18), eicosenoic acid (C20), eicosadienoic acid (C20), docosadienoic acid (C22), pinolenic acid (C18), eleostearic acid (C18), mead acid (C20), adrenic acid (C22), clupanodonic acid (C22), nishinic acid (C24), and tetracosapentaenoic acid (C24).

(B) The basic metal salt of the fatty acid is preferably a basic metal salt of a fatty acid having 8 to 30 carbon atoms, and more preferably a basic metal salt of a fatty acid having 12 to 24 carbon atoms. Specific examples of (B) the basic metal salt of the fatty acid include basic magnesium laurate, basic calcium laurate, basic zinc laurate, basic magnesium myristate, basic calcium myristate, basic zinc myristate, basic magnesium palmitate, basic calcium palmitate, basic zinc palmitate, basic magnesium oleate, basic calcium oleate, basic zinc oleate, basic magnesium stearate, basic calcium stearate, basic zinc stearate, basic magnesium 12-hydroxystearate, basic calcium 12-hydroxystearate, basic zinc 12-hydroxystearate, basic magnesium behenate, basic calcium behenate, and basic zinc behenate. (B) The basic metal salt of the fatty acid preferably includes a basic magnesium salt of a fatty acid, and more preferably basic magnesium stearate, basic magnesium behenate, basic magnesium laurate, and basic magnesium oleate. (B) The basic metal salt of the fatty acid may be used alone or as a mixture of at least two of them. There is no particular limitation on the melting point of (B) the basic metal salt of the fatty acid, but if the metal is magnesium, the melting point is preferably 100° C. or more, and is preferably 300° C. or less, more preferably 290° C. or less, even more preferably 280° C. or less. If the melting point falls within the above range, the dispersibility to the resin component becomes better.

(B) The basic metal salt of the fatty acid preferably contains the metal component in an amount of 1 mole % or more, more preferably 1.1 mole % or more, and preferably contains the metal component in an amount of 2 mole % or less, more preferably 1.9 mole % or less. If the content of the metal component falls within the above range, the resilience of the obtained golf ball constituent member further improves. The content of the metal component of (B) the basic metal salt of the fatty acid is a value calculated by dividing the metal amount (g) contained per 1 mole of the metal salt by the atomic weight of the metal, and is expressed in mole %.

The content of (B) the basic metal salt of the fatty acid in the thermoplastic resin composition used in the present invention is preferably 5 parts by mass or more, more preferably 8 parts by mass or more, even more preferably 10 parts by mass or more, and is preferably 100 parts by mass or less, more preferably 90 parts by mass or less, with respect to 100 parts by mass of (A) the resin component. If the content of (B) the basic metal salt of the fatty acid is 5 parts by mass or more, the resilience of the golf ball constituent member improves, while if the content is 100 parts by mass or less, it is possible to suppress the lowering of the durability of the golf ball constituent member due to the increase in the low-molecular weight component.

Examples of the resin component constituting the center of the multi-piece golf ball of the present invention preferably include the ionomer resin, the thermoplastic olefin copolymer, the thermoplastic styrene-based elastomer or the mixture thereof. As the resin component, a resin component containing the thermoplastic styrene-based elastomer is preferable. Examples of the thermoplastic styrene-based elastomer preferably include the alloy of the polyolefin with one kind or two or more kinds selected from the group consisting of SBS, SIS, SIBS, SEBS, SEPS, SEEPS and the hydrogenated products thereof. The content of the thermoplastic styrene-based elastomer in the resin component constituting the center is preferably 5 mass % or more, more preferably 10 mass % or more, and is preferably 100 mass % or less, more preferably 80 mass % or less.

Examples of the preferable embodiment of the resin component constituting the center include the following embodiments.

(1) An embodiment where the resin component contains the ionomer resin and the thermoplastic styrene-based elastomer. In a more preferable embodiment, the resin component contains the ternary ionomer resin and the alloy of the polyolefin with one kind or two or more kinds selected from the group consisting of SBS, SIS, SIBS, SEBS, SEPS, SEEPS and the hydrogenated products thereof.

(2) An embodiment where the resin component contains the ionomer resin and the thermoplastic styrene-based elastomer, and further contains the basic metal salt of the fatty acid for increasing the degree of neutralization of the ionomer resin. In a more preferable embodiment, the resin component contains the ternary ionomer resin, the alloy of the polyolefin with one kind or two or more kinds selected from the group consisting of SBS, SIS, SIBS, SEBS, SEPS, SEEPS and the hydrogenated products thereof, and further contains the basic metal salt of the fatty acid for increasing the degree of neutralization of the ionomer resin.

(3) An embodiment where the resin component contains the thermoplastic olefin copolymer and the thermoplastic styrene-based elastomer, and further contains the basic metal salt of the fatty acid for increasing the degree of neutralization of the thermoplastic olefin copolymer. Examples of the thermoplastic olefin copolymer preferably include the binary copolymer composed of the olefin and the α,β-unsaturated carboxylic acid having 3 to 8 carbon atoms and/or the ternary copolymer composed of the olefin, the α,β-unsaturated carboxylic acid having 3 to 8 carbon atoms and the α,β-unsaturated carboxylic acid ester. Examples of the thermoplastic styrene-based elastomer preferably include the alloy of the polyolefin with one kind or two or more kinds selected from the group consisting of SBS, SIS, SIBS, SEBS, SEPS, SEEPS and the hydrogenated products thereof.

The resin component constituting the nth envelope layer (the outmost layer) preferably contains an ionomer resin, a thermoplastic polyurethane resin (including a thermoplastic polyurethane elastomer), or a mixture thereof. If the resin component constituting the nth envelope layer (the outmost layer) contains the ionomer resin, for example, the golf ball showing excellent durability and travelling a long distance can be obtained. If the resin component constituting the nth envelope layer (the outmost layer) contains the thermoplastic polyurethane resin (including a thermoplastic polyurethane elastomer), the golf ball showing excellent shot feeling and controllability can be obtained.

The thermoplastic resin composition used in the present invention may further contain (C) an additive. Examples of (C) the additive include a pigment component such as a white pigment (for example, titanium oxide), a blue pigment or the like; a weight adjusting agent; a dispersant; an antioxidant; an ultraviolet absorber; a light stabilizer; a fluorescent material; a fluorescent brightener; or the like. Examples of the adjusting agent include, for example, zinc oxide, barium sulfate, calcium carbonate, magnesium oxide, tungsten powder, molybdenum powder, and the like.

The content of the white pigment (for example, titanium oxide), with respect to 100 parts by mass of (A) the resin component, is preferably 0.5 part by mass or more, more preferably 1 part by mass or more, and is preferably 10 parts by mass or less, more preferably 8 parts by mass or less. If the content of the white pigment is 0.5 parts by mass or more, it is possible to impart the opacity to the golf ball constituent member. If the content of the white pigment is more than 10 parts by mass, the durability of the obtained golf ball constituent member may deteriorate.

The thermoplastic resin composition used in the present invention can be obtained, for example, by dry blending (A) the resin component and (C) the additive. (B) The basic metal salt of the fatty acid is dry blended where necessary. Further, the dry blended mixture may be extruded into a pellet form. The dry blending is preferably carried out by using for example, a mixer capable of blending raw materials in a pellet form, more preferably carried out by using a tumbler type mixer. Extruding can be carried out by using the publicly known extruder such as a single-screw extruder, a twin-screw extruder, and a twin-single extruder.

In the multi-piece golf ball of the present invention, the center is formed from the above-mentioned thermoplastic resin composition, and the second envelope layer is formed from the above-mentioned thermoplastic resin composition or a rubber composition which will be explained below. The first envelope layer, and the third envelope layer to the nth envelope layer may be formed from either the above-mentioned thermoplastic resin composition or the rubber composition which will be explained below. If the envelope layer is formed from the above-mentioned thermoplastic resin composition, the moldability thereof improves. On the other hand, if the envelope layer is formed from the rubber composition which will be explained below, the obtained golf ball shows better resilience.

Next, the rubber composition which can be used for the envelope layer of the present invention will be explained. Examples of the rubber composition include, for example, a composition containing a base rubber, a crosslinking initiator, a co-crosslinking agent, and a filler.

As the base rubber, a natural rubber and/or a synthetic rubber may be used. Examples of the base rubber include a polybutadiene rubber, a natural rubber, a polyisoprene rubber, a styrene polybutadiene rubber, and an ethylene-propylene-diene rubber (EPDM). These rubbers can be used solely or as a combination of two or more kinds. Among them, particularly preferred is a high cis-polybutadiene having cis-1,4-bond in a content of 40 mass % or more, more preferably 80 mass % or more, even more preferably 90 mass % or more in view of superior resilience.

The high cis-polybutadiene preferably has 1,2-vinyl bond in a content of 2 mass % or less, more preferably 1.7 mass % or less, and even more preferably 1.5 mass % or less. If the content of 1,2-vinyl bond is excessively high, the resilience may be lowered.

The high cis-polybutadiene preferably includes a product synthesized by using a rare-earth element catalyst. When a neodymium catalyst employing a neodymium compound which is a lanthanum series rare-earth element compound, is used, a polybutadiene rubber having a high content of cis-1,4 bond and a low content of 1,2-vinyl bond can be obtained with excellent polymerization activity, thus such a polybutadiene rubber is particularly preferred.

The high cis-polybutadiene preferably has a Mooney viscosity ($ML_{1+4}$ (100° C.)) of 30 or more, more preferably 32 or more, even more preferably 35 or more, and preferably has a Mooney viscosity ($ML_{1+4}$ (100° C.)) of 140 or less, more preferably 120 or less, even more preferably 100 or less, most preferably 80 or less. It is noted that the Mooney viscosity ($ML_{1+4}$ (100° C.)) in the present invention is a value measured according to JIS K6300 using an L rotor under the conditions of: a preheating time of 1 minute; a rotor rotation time of 4 minutes; and a temperature of 100° C.

The high cis-polybutadiene preferably has a molecular weight distribution Mw/Mn (Mw: weight average molecular weight, Mn: number average molecular weight) of 2.0 or more, more preferably 2.2 or more, even more preferably 2.4 or more, most preferably 2.6 or more, and preferably has a molecular weight distribution Mw/Mn of 6.0 or less, more preferably 5.0 or less, even more preferably 4.0 or less, most preferably 3.4 or less. If the molecular weight distribution (Mw/Mn) of the high cis-polybutadiene is excessively low, the processability may deteriorate. If the molecular weight distribution (Mw/Mn) of the high cis-polybutadiene is excessively high, the resilience may be lowered. It is noted that the molecular weight distribution is measured by gel permeation chromatography ("HLC-8120GPC" manufactured by Tosoh Corporation) using a differential refractometer as a detector under the conditions of column: GMH-HXL (manufactured by Tosoh Corporation), column temperature: 40° C., and mobile phase: tetrahydrofuran, and calculated by converting based on polystyrene standard.

The crosslinking initiator is blended to crosslink the base rubber component. As the crosslinking initiator, an organic peroxide is preferably used. Specific examples of the organic peroxide are dicumyl peroxide, 1,1-bis(t-butylperoxy)-3,3,5-trimethylcyclohexane, 2,5-dimethyl-2,5-di(t-butylperoxy) hexane, and di-t-butyl peroxide. Among them, dicumyl peroxide is preferably used. The blending amount of the crosslinking initiator is preferably 0.3 part by mass or more, more preferably 0.4 part by mass or more, and is preferably 5 parts by mass or less, more preferably 3 parts by mass or less, with respect to 100 parts by mass of the base rubber. If the amount is less than 0.3 part by mass, the resultant envelope layer becomes so soft that the resilience tends to be lowered, and if the amount is more than 5 parts by mass, the amount of the co-crosslinking agent must be decreased to obtain an appropriate hardness, which tends to cause the insufficient resilience.

The co-crosslinking agent is considered to have an action of crosslinking a rubber molecule by graft polymerization to a base rubber molecular chain. As the co-crosslinking agent, for example, an α,β-unsaturated carboxylic acid having 3 to 8 carbon atoms or a metal salt thereof can be used, examples thereof preferably include acrylic acid, methacrylic acid and a metal salt thereof. Examples of the metal constituting the metal salt include zinc, magnesium, calcium, aluminum and sodium, among them, zinc is preferably used because it provides high resilience.

The amount of the co-crosslinking agent to be used is preferably 10 parts by mass or more, more preferably 15 parts by mass or more, even more preferably 20 parts by mass or more, and is preferably 55 parts by mass or less, more preferably 50 parts by mass or less, even more preferably 48 parts by mass or less, with respect to 100 parts by mass of the base rubber. If the amount of the co-crosslinking agent to be used is less than 10 parts by mass, the amount of the crosslinking initiator must be increased to obtain an appropriate hardness, which tends to lower the resilience. On the other hand, if the amount of the co-crosslinking agent to be used is more than 55 parts by mass, the resultant envelope layer becomes so hard that the shot feeling may be lowered.

The filler contained in the rubber composition is mainly blended as a weight adjusting agent in order to adjust the weight of the golf ball obtained as a final product, and may be blended where necessary. Examples of the filler include an inorganic filler such as zinc oxide, barium sulfate, calcium carbonate, magnesium oxide, tungsten powder, and molybdenum powder. The blending amount of the filler is preferably 0.5 part by mass or more, more preferably 1 part by mass or more, and is preferably 30 parts by mass or less, more preferably 20 parts by mass or less, with respect to 100 parts by mass of the base rubber. If the blending amount of the filler is less than 0.5 part by mass, it becomes difficult to adjust the weight, while if it is more than 30 parts by mass, the weight ratio of the rubber component becomes small and the resilience tends to be lowered.

An organic sulfur compound, an antioxidant, a peptizing agent or the like may be blended appropriately in the rubber composition, in addition to the base rubber, the crosslinking initiator, the co-crosslinking agent and the filler.

Examples of the organic sulfur compound include thiophenols, thionaphthols, polysulfides, thiocarboxylic acids, dthiocarboxylic acids, sulfenamindes, thiurams, dithiocarbamates, thiazoles, and the like. Among them, diphenyl disulfides may be preferably used as the organic sulfur compound. Examples of diphenyl disulfides include, for example, diphenyl disulfide; a mono-substituted diphenyl disulfide such as bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide, bis(4-cyanophenyl)disulfide; a di-substituted diphenyl disulfide such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, bis(2-cyano-5-bromophenyl)disulfide; a tri-substituted diphenyl disulfide such as bis(2,4,5-trichlorophenyl)disulfide, bis(2,4,6-trichlorophenyl)disulfide, bis(2-cyano-4-chloro-6-bromophenyl)disulfide; a tetra-substituted diphenyl disulfide such as bis(2,3,5,6-tetra chlorophenyl) disulfide; a penta-substituted diphenyl disulfide such as bis(2,3,4,5,6-pentachlorophenyl)disulfide, bis(2,3,4,5,6-pentabromophenyl)disulfide. These diphenyl disulfides can enhance resilience by having some influence on the state of vulcanization of vulcanized rubber. Among them, diphenyl disulfide or bis (pentabromophenyl) disulfide is preferably used since the golf ball having particularly high resilience can be obtained. The blending amount of the organic sulfur compound is preferably 0.1 part by mass or more, more preferably 0.3 part by mass or more, and is preferably 5.0 parts by mass or less, more preferably 3.0 parts by mass or less, with respect to 100 parts by mass of the base rubber.

The blending amount of the antioxidant is preferably 0.1 part by mass or more and 1 part by mass or less with respect to 100 parts by mass of the base rubber. Further, the blending amount of the peptizing agent is preferably 0.1 part by mass or more and 5 parts by mass or less with respect to 100 parts by mass of the base rubber.

The raw materials are kneaded to prepare the rubber composition, and the resultant rubber composition is molded into the envelope layer in a mold.

(3) Method for Producing the Multi-Piece Golf Ball of the Present Invention

The center can be obtained, for example, by injection molding the thermoplastic resin composition. Specifically, it is preferred that the thermoplastic resin composition heated and melted at a temperature of 160° C. to 260° C. is charged into a mold held under a pressure of 1 MPa to 100 MPa for 1 second to 100 seconds, and after cooling for 30 second to 300 seconds, the mold is opened.

The method for molding the rubber composition into the envelope layer is not particularly limited, and for example, include a method comprising the steps of: molding the rubber composition into a half shell having a shape of hemispherical hollow shell beforehand, covering the spherical body with two half shells, and compression molding at 130° C. to 170° C. for 5 minutes to 30 minutes. The envelope layer may also be formed by injection molding the rubber composition.

The method for molding the thermoplastic resin composition into the envelope layer is not particularly limited. For example, a method comprising the steps of: molding the thermoplastic resin composition into a half shell having a shape of hemispherical hollow shell beforehand, covering the spherical body with two half shells, and compression molding at 130° C. to 170° C. for 1 minute to 30 minutes; a method of directly injection molding the thermoplastic resin composition onto the spherical body to cover the spherical body; and the like can be employed. The envelope layer of the multi-piece golf ball of the present invention is preferably formed by injection molding method. By employing the injection molding method, it is easier to produce the envelope layer.

When injection molding the thermoplastic resin composition onto the spherical body to mold the envelope layer, it is preferred to use upper and lower molds having a hemispherical cavity and pimples wherein a part of the pimple also serves as a retractable hold pin. When molding the envelope layer by injection molding, the spherical body is placed in the mold, held with the protruding hold pin, and the thermoplastic resin composition which is heated and melted is charged and then cooled to mold the envelope layer.

When molding the envelope layer by compression molding method, the half shell can be molded by either compression molding method or injection molding method, but compression molding method is preferred. Compression molding the thermoplastic resin composition into the half shell can be carried out, for example, under a pressure of 1 MPa or more and 20 MPa or less at a molding temperature of −20° C. or more and 70° C. or less relative to the flow beginning temperature of the thermoplastic resin composition. By carrying out the molding under the above conditions, the half shell with a uniform thickness can be formed. Examples of a method for molding the envelope layer with half shells include, for example, a method of covering the spherical body with two half shells and then performing compression molding. Compression molding the half shells into the envelope layer can be carried out, for example, under a molding pressure of 0.5 MPa or more and 25 MPa or less at a molding temperature of −20° C. or more and 70° C. or less relative to the flow beginning temperature of the thermoplastic resin composition. By carrying out the molding under the above conditions, the envelope layer with a uniform thickness can be formed.

The molding temperature means the highest temperature where the temperature at the surface of the concave portion of the lower mold reaches from closing the mold to opening the mold. Further, the flow beginning temperature of the thermoplastic resin composition can be measured in a pellet form under the following conditions by using "Flow Tester CFT-500" manufactured by Shimadzu Corporation.

Measuring conditions: Plunger Area: 1 $cm^2$, Die length: 1 mm, Die diameter: 1 mm, Load: 588.399 N, Start temperature: 30° C., and Temperature increase rate: 3° C./min.

The concave portions called "dimple" are usually formed on the surface of the nth envelope layer (the outmost layer). The total number of dimples formed on the nth envelope layer (the outmost layer) is preferably 200 or more and 500 or less. If the total number of dimples is less than 200, the dimple effect is hardly obtained. On the other hand, if the total number of dimples exceeds 500, the dimple effect is hardly obtained because the size of the respective dimple is small. The shape (shape in a plan view) of dimples includes, without limitation, a circle; a polygonal shape such as a roughly triangular shape, a roughly quadrangular shape, a roughly pentagonal shape, a roughly hexagonal shape; or other irregular shape. The shape of dimples is employed solely or in combination of at least two of them.

After the nth envelope layer (the outmost layer) is molded, the obtained golf ball body is ejected from the mold, and is preferably subjected to surface treatments such as deburring, cleaning and sandblast where necessary. If desired, a paint film or a mark may be formed. The paint film preferably has a thickness of, but not limited to, 5 μm or larger, and more preferably 7 μm or larger, and preferably has a thickness of 50 μm or smaller, more preferably 40 μm or smaller, even more preferably 30 μm or smaller. If the thickness of the paint film is smaller than 5 μm, the paint film is easy to wear off due to continued use of the golf ball, and if the thickness of the paint film is larger than 50 μm, the dimple effect is reduced, resulting in lowering flying performance of the golf ball.

EXAMPLES

Hereinafter, the present invention will be described in detail by way of example. The present invention is not limited to examples described below. Various changes and modifications can be made without departing from the spirit and scope of the present invention.

(1) Material Hardness (Shore D Hardness)

In case of the thermoplastic resin composition, sheets with a thickness of about 2 mm were produced by injection molding the thermoplastic resin composition. In case of the rubber composition, sheets with a thickness of about 2 mm were produced by pressing the rubber composition at 170° C. for 25 minutes. These sheets were stored at 23° C. for two weeks. Three or more of these sheets were stacked on one another so as not to be affected by the measuring substrate on which the sheets were placed, and the hardness of the stack was measured with a type P1 auto loading durometer manufactured by Kobunshi Keiki Co., Ltd., provided with a Shore D type spring hardness tester prescribed in ASTM-D2240.

(2) Compression Deformation Amount (mm)

The compression deformation amount of the center or the golf ball along the compression direction (the shrinking amount of the center or the golf ball along the compression direction), when applying a load from an initial load of 98N to a final load of 1275N to the center or the golf ball, was measured.

(3) Spin Rate on Approach Shots (Controllability)

The spin rate (rpm) was measured on about 40 yard-approach shots which ten testers having a handicap of 10 or less hit from the fairway in the golf course. The measurement was conducted by hitting each golf ball with a CG15 forged wedge (58°) manufactured by Cleveland Golf. A sequence of photographs of the hit golf ball were taken for measuring the spin rate (rpm). The average value of the ten testers is adopted as the spin rate (rpm).

(4) Spin Rate on Iron Shots (rpm)

A #5 iron (Z-TX, manufactured by Dunlop Sports Limited) was installed on a swing robot M/C manufactured by Golf Laboratories, Inc. The golf ball was hit at a head speed of 41 m/sec, and the spin rate right after hitting the golf ball was measured. The measurement was conducted twelve times for each golf ball, and the average value thereof was adopted as the measurement value for the golf ball. A sequence of photographs of the hit golf ball were taken for measuring the spin rate right after hitting the golf ball.

[Production of Golf Balls]

(1) Preparation of Thermoplastic Resin Composition

As shown in Table 1, the blending materials were dry blended, followed by mixing with a twin-screw kneading extruder to extrude the blended material in a strand form into the cool water. The extruded strand was cut with a pelletizer to prepare the thermoplastic resin composition in a pellet form. Extrusion was performed in the following conditions: screw diameter: 45 mm, screw revolutions: 200 rpm; and screw L/D=3. The blending materials were heated to a temperature in a range from 160° C. to 230° C. at the die position of the extruder.

TABLE 1

| | Thermoplastic resin composition No. | | | | | | | | | | |
|---|---|---|---|---|---|---|---|---|---|---|---|
| | a | b | c | d | e | f | g | h | i | k | l |
| Himilan AM7327 | — | — | 50 | — | — | — | — | — | — | — | — |
| Nucrel AN4319 | — | — | — | 40 | — | — | — | — | — | — | — |
| Himilan 1605 | — | — | — | — | — | — | — | — | — | 50 | — |
| Himilan AM7329 | — | — | — | — | — | — | — | — | — | 50 | — |
| HPF2000 | 100 | — | — | — | 75 | 60 | 50 | 25 | — | — | — |
| HPF1000 | — | 100 | — | — | — | — | — | — | — | — | — |
| Rabalon T3221C | — | — | 50 | 60 | 25 | 40 | 50 | 75 | 100 | — | — |
| Elastollan XNY84A | — | — | — | — | — | — | — | — | — | — | 100 |
| Basic magnesium oleate | — | — | 15 | 28 | — | — | — | — | — | — | — |
| Titanium oxide | — | — | — | — | — | — | — | — | — | 4 | 4 |
| Shore D hardness | 45 | 54 | 27 | 23 | 35 | 29 | 25 | 15 | 5 | 65 | 32 |

Formulation: parts by mass

Materials used in Table 1 are follows.

Himilan AM7327: zinc ion-neutralized ethylene-methacrylic acid-butyl acrylate ternary copolymer ionomer resin (melt flow rate (190° C.×2.16 kgf): 0.7 g/10 min, bending stiffness: 35 MPa) manufactured by Mitsui-Du Pont Polychemicals Co., Ltd. Nucrel AN4319: ethylene-methacrylic acid-butyl acrylate copolymer (melt flow rate (190° C.×2.16 kgf): 55 g/10 min, bending stiffness: 21 MPa) manufactured by Mitsui-Du Pont Polychemicals Co., Ltd.

HPF2000: magnesium ion-neutralized ternary copolymer ionomer resin (melt flow rate (190° C.×2.16 kgf): 1.0 g/10 min, bending stiffness: 64 MPa) manufactured by Du Pont Co., Ltd.

HPF1000: magnesium ion-neutralized ternary copolymer ionomer resin (Melt Flow Rate (190° C.×2.16 kgf): 0.7 g/10 min, Bending Stiffness: 190 MPa) manufactured by E.I. du Pont de Nemours and Company Himilan 1605: sodium ion-neutralized ethylene-methacrylic acid copolymer ionomer resin (melt flow rate (190° C.×2.16 kgf): 2.8 g/10 min, bending stiffness: 320 MPa) manufactured by Mitsui-Du Pont Polychemicals Co., Ltd.

Himilan AM7329: zinc ion-neutralized ethylene-methacrylic acid copolymer ionomer resin (melt flow rate (190° C.×2.16 kgf): 5 g/10 min, bending stiffness: 221 MPa) manufactured by Mitsui-Du Pont Polychemicals Co., Ltd.

Basic magnesium oleate: (metal content: 1.7 mole %, in the formula (4), $M^1M^2$=Mg, R=17 carbon atoms) manufactured by Nitto kasei Kougyo Co., Ltd.

Rabalon T3221C: thermoplastic styrene elastomer (alloy of a polyolefin with one kind or two or more kinds selected from the group consisting of SBS, SIS, SIBS, SEBS, SEPS, SEEPS and hydrogenated products thereof) manufactured by Mitsubishi Chemical Corporation Elastollan XNY84A: thermoplastic polyurethane elastomer manufactured by BASF Japan Ltd.

Titanium oxide: A220 manufactured by Ishihara Sangyo Co., Ltd.

(2) Preparation of Rubber Composition

The materials shown in Table 2 were mixed and kneaded to prepare the rubber composition.

TABLE 2

| | Rubber composition No. | | | | |
|---|---|---|---|---|---|
| | A | B | C | D | E |
| Polybutadiene rubber | 100 | 100 | 100 | 100 | 100 |
| Zinc acrylate | 18 | 37 | 10 | 5 | 20 |
| Zinc oxide | 5 | 5 | 5 | 5 | 5 |
| Diphenyl disulfide | 0.5 | — | 0.5 | 0.5 | 0.5 |
| Bis(pentabromophenyl) disulfide | — | 0.3 | — | — | — |
| Dicumyl peroxide | 0.7 | 0.9 | 0.7 | 0.7 | 0.7 |
| Barium sulfate | *1) | *1) | *1) | *1) | *1) |
| Shore D hardness | 37 | 58 | 27 | 19 | 45 |

Formulation: parts by mass

*1) As to an amount of barium sulfate, adjustment was made such that the golf ball had a mass of 45.4 g.

Materials used in Table 2 are follows.

Polybutadiene rubber: "BR-730 (high-cis polybutadiene, cis-1,4 bond content=96 mass %, 1,2-vinyl bond content=1.3 mass %, Moony viscosity ($ML_{1+4}$ (100° C.)=55, molecular weight distribution (Mw/Mn)=3)" manufactured by JSR Corporation Zinc acrylate: "ZNDA-90S" manufactured by Nihon Jyoryu Kogyo Co., Ltd. Zinc oxide: "Ginrei (registered trademark) R" manufactured by Toho Zinc Co., Ltd.

Barium sulfate: "Barium Sulfate BD" manufactured by Sakai Chemical Industry Co., Ltd.

Dicumyl peroxide: "Percumyl (registered trademark) D" manufactured by NOF Corporation Diphenyl disulfide: manufactured by Sumitomo Seika Chemicals Co., Ltd.

(3) Production of Spherical Center

As shown in Tables 4 to 7, the obtained thermoplastic resin compositions in a pellet form were injection molded at 200° C. to produce the spherical centers. For the golf ball No. 13, the rubber composition No. A shown in Table 2 was pressed at 170° C. for 25 minutes to mold the spherical center.

(4) Production of First Envelope Layer from Thermoplastic Resin Composition

As shown in Table 4 to 7, the obtained thermoplastic resin compositions were injection molded at 200° C. to mold the first envelope layer.

(5) Production of Envelope Layer from Rubber Composition

As shown in Table 4 and 5, the rubber compositions shown in Table 2 were molded into half shells. The spherical body composed of the center and the first envelope layers was covered with two half shells. The spherical body and the half shells were placed together into the mold consisting of upper and lower molds which have a hemispherical cavity, and then heated at 170° C. for 25 minutes to produce the second envelope layer from the rubber composition. For the golf ball No. 13, under the same conditions, the first envelope layer was formed from the rubber composition onto the spherical rubber center, thereby forming a two-layered core formed from the rubber compositions. The properties of the two-layered core were shown in Table 3.

TABLE 3

| Two-layered core structure | |
|---|---|
| Center Rubber composition | A |
| Center diameter (mm) | 15 |
| Compression deformation amount of Center (mm) | 6.45 |
| Envelop Layer Rubber composition | B |
| Envelope layer thickness (mm) | 12.4 |
| Core diameter (mm) | 39.8 |
| Compression deformation amount of Core(mm) | 2.81 |
| Center hardness of Core (Shore D) | 34 |
| Surface hardness of core (Shore D) | 58 |

(6) Production of the Second Envelope Layer to the Nth Envelope Layer, or the Third Envelope Layer to the Nth Envelope Layer from Thermoplastic Resin Composition As shown in Tables 4 to 7, the obtained thermoplastic resin compositions were injection molded at 200° C. to form the second envelope layer to the n−1th envelope layer or the third envelope layer to the n−1th envelope layer. The nth envelope layer (the outmost layer) was formed by compression molding the obtained thermoplastic resin composition. Compression molding of the half shells was conducted by charging one pellet of the obtained thermoplastic resin composition into each concave portion of the lower mold of the mold which is used for molding the half shells and pressing the thermoplastic resin composition. Compression molding was conducted under the conditions of a molding temperature of 160° C., a molding time of 2 minutes, and a molding pressure of 11 MPa. The spherical body after the n−1th envelope layer had been formed was concentrically covered with two half shells, then charged into the mold having plurality of pimples on a surface of the cavity thereof, and compression molded to form the cover. Compression molding was conducted under the conditions of a molding temperature of 150° C., a molding time of 3 minutes and a molding pressure of 13 MPa. Plurality of dimples having a reversed shape of the pimple shape were formed on the nth envelope layer (the outmost layer) after molding. For the golf balls Nos. 1 to 7, 9, 14, 15, 17 to 21, 23 to 25, six envelope layers covering the spherical center were formed, and for the golf balls Nos. 8, 10 to 12, 16, 22, 24, 26 to 28, five envelope layers covering the spherical center were formed.

The surface of the obtained golf ball body was treated with sandblast, marked, and painted with a clear paint. The paint was dried in an oven at 40° C., and the golf ball having a diameter of 42.8 mm and a mass of 45.4 g was obtained. The evaluation results with respect to the obtained golf ball were shown in Tables 4 to 7.

TABLE 4

| | | Golf ball No. | | | | | |
|---|---|---|---|---|---|---|---|
| | | 1 | 2 | 3 | 4 | 5 | 6 |
| Structure | Center material No. | f | f | f | f | f | f |
| | Center hardness H0 (Shore D) | 29 | 29 | 29 | 29 | 29 | 29 |
| | Center diameter (mm) | 15 | 20 | 25 | 15 | 20 | 20 |
| | Center surface hardness (Shore D) | 30 | 30 | 30 | 30 | 30 | 30 |
| | 1st envelope layer material No. | a | a | a | a | a | e |
| | 1st envelope layer hardness H1 (Shore D) | 45 | 45 | 45 | 45 | 45 | 35 |
| | 1st envelope layer thickness (mm) | 2.5 | 2.5 | 2.5 | 2.5 | 2.5 | 2.5 |
| | 1st envelope layer surface hardness S1 (Shore D) | 46 | 46 | 48 | 46 | 46 | 36 |
| | 2nd envelope layer material No. | C | C | C | D | D | D |
| | 2nd envelope layer hardness H2 (Shore D) | 27 | 27 | 27 | 13 | 19 | 19 |
| | 2nd envelope layer thickness (mm) | 2.5 | 2.5 | 2.5 | 2.5 | 2.5 | 2.5 |
| | 2nd envelope layer surface hardness S2 (Shore D) | 28 | 28 | 28 | 20 | 20 | 20 |
| | 3rd envelope layer material No. | a | a | b | a | a | a |
| | 3rd envelope layer hardness H3 (Shore D) | 45 | 45 | 54 | 45 | 45 | 45 |
| | 3rd envelope layer thickness (mm) | 5 | 2.5 | 1.9 | 5 | 2.5 | 2.5 |
| | 3rd envelope layer surface hardness S3 (Shore D) | 46 | 46 | 55.0 | 46 | 46 | 46 |
| | 4th envelope layer material No. | b | b | k | b | b | b |
| | 4th envelope layer hardness H4 (Shore D) | 54 | 54 | 65 | 54 | 54 | 54 |
| | 4th envelope layer thickness (mm) | 2.4 | 2.4 | 1 | 2.4 | 2.4 | 2.4 |
| | 4th envelope layer surface hardness S4 (Shore D) | 55.0 | 55.0 | 66 | 55.0 | 55.0 | 55.0 |
| | 5th envelope layer material No. | k | k | l | k | k | k |
| | 5th envelope layer hardness H5 (Shore D) | 65 | 85 | 32 | 65 | 85 | 65 |
| | 5th envelope layer thickness (mm) | 1 | 1 | 0.5 | 1 | 1 | 1 |
| | 5th envelope layer surface hardness S5 (Shore D) | 66 | 66 | 65 | 66 | 66 | 66 |
| | 5th envelope layer material No. | l | l | l | l | l | l |
| | 6th envelope layer hardness H6 (Shore D) | 32 | 32 | 32 | 32 | 32 | 32 |
| | 6th envelope layer thickness (mm) | 0.5 | 0.5 | 0.5 | 0.5 | 0.5 | 0.5 |
| | 6th envelope layer surface hardness S6 (Shore D) | 65 | 65 | 65 | 65 | 65 | 65 |
| | H0-H2 | 2 | 2 | 2 | 10 | 10 | 10 |
| | Hn-1-H0 | 36 | 36 | 38 | 36 | 36 | 36 |
| Properties | Compression deformation amount (mm) | 2.81 | 2.84 | 3.14 | 2.87 | 2.91 | 3.03 |
| | Iron spin rate Si (rpm) | 5300 | 5120 | 4940 | 4800 | 4890 | 4880 |
| | Approach spin rate Sa (rpm) | 6760 | 6740 | 6510 | 6660 | 6640 | 6660 |
| | Si/Sa | 0.78 | 0.76 | 0.76 | 0.72 | 0.74 | 0.73 |

TABLE 5

| | | Golf ball No. | | | | | | |
|---|---|---|---|---|---|---|---|---|
| | | 7 | 8 | 9 | 10 | 11 | 12 | 13 |
| Structure | Center material No. | g | f | e | g | a | f | A |
| | Center hardness H0 (Shore D) | 25 | 29 | 35 | 25 | 45 | 29 | 37 |
| | Center diameter (mm) | 15 | 20 | 15 | 15 | 15 | 15 | 15 |
| | Center surface hardness (Shore D) | 26 | 30 | 36 | 26 | 46 | 30 | 40 |
| | 1st envelope layer material No. | a | a | g | a | g | g | B |
| | 1st envelope layer hardness H1 (Shore D) | 45 | 45 | 25 | 45 | 25 | 25 | — |
| | 1st envelope layer thickness (mm) | 2.5 | 5 | 2.5 | 2.5 | 2.5 | 2.5 | 12.4 |
| | 1st envelope layer surface hardness S1 (Shore D) | 46 | 46 | 26 | 46 | 26 | 26 | 58 |
| | 2nd envelope layer material No. | D | C | D | E | E | E | k |
| | 2nd envelope layer hardness H2 (Shore D) | 19 | 19 | 19 | 45 | 45 | 45 | 65 |
| | 2nd envelope layer thickness (mm) | 2.5 | 2.5 | 2.5 | 7.5 | 7.5 | 7.5 | 1 |
| | 2nd envelope layer surface hardness S2 (Shore D) | 20 | 20 | 20 | 46 | 46 | 46 | 66 |
| | 3rd envelope layer material No. | a | b | a | b | b | g | l |
| | 3rd envelope layer hardness H3 (Shore D) | 45 | 54 | 45 | 54 | 54 | 25 | 32 |
| | 3rd envelope layer thickness (mm) | 5 | 2.4 | 5.0 | 2.4 | 2.4 | 2.4 | 0.5 |
| | 3rd envelope layer surface hardness S3 (Shore D) | 46 | 55.0 | 46.0 | 55.0 | 55.0 | 26.0 | 65 |
| | 4th envelope layer material No. | b | k | b | k | k | k | — |
| | 4th envelope layer hardness H4 (Shore D) | 54 | 65 | 54 | 65 | 65 | 65 | — |
| | 4th envelope layer thickness (mm) | 2.4 | 1 | 2.4 | 1 | 1 | 1 | — |
| | 4th envelope layer surface hardness S4 (Shore D) | 55.0 | 66 | 55.0 | 66 | 66 | 66 | — |
| | 5th envelope layer material No. | k | l | k | l | l | l | — |
| | 5th envelope layer hardness H5 (Shore D) | 65 | 32 | 65 | 32 | 32 | 32 | — |
| | 5th envelope layer thickness (mm) | 1 | 0.5 | 1 | 0.5 | 0.5 | 0.5 | — |
| | 5th envelope layer surface hardness S5 (Shore D) | 66 | 65 | 66 | 65 | 65 | 65 | — |
| | 5th envelope layer material No. | l | — | l | — | — | — | — |
| | 6th envelope layer hardness H6 (Shore D) | 32 | — | 32 | — | — | — | — |
| | 6th envelope layer thickness (mm) | 0.5 | — | 0.5 | — | — | — | — |
| | 6th envelope layer surface hardness S6 (Shore D) | 65 | — | 65 | — | — | — | — |

TABLE 5-continued

| | | Golf ball No. | | | | | | |
|---|---|---|---|---|---|---|---|---|
| | | 7 | 8 | 9 | 10 | 11 | 12 | 13 |
| | H0-H2 | 6 | 10 | 16 | −20 | 0 | −16 | — |
| | Hn-1-H0 | 40 | 36 | 30 | 40 | 20 | 36 | — |
| Properties | Compression deformation amount (mm) | 2.85 | 2.83 | 3.07 | 2.64 | 2.45 | 2.95 | 2.60 |
| | Iron spin rate Si (rpm) | 4750 | 5220 | 4900 | 5580 | 5800 | 5620 | 5200 |
| | Approach spin rate Sa (rpm) | 6650 | 6770 | 6670 | 6590 | 6800 | 6600 | 6100 |
| | Si/Sa | 0.71 | 0.77 | 0.73 | 0.85 | 0.85 | 0.85 | 0.85 |

TABLE 6

| | | Golf ball No. | | | | | | |
|---|---|---|---|---|---|---|---|---|
| | | 14 | 15 | 16 | 17 | 18 | 19 | 20 |
| Structure | Center material No. | f | f | f | f | f | f | c |
| | Center hardness H0 (Shore D) | 29 | 29 | 29 | 29 | 29 | 29 | 27 |
| | Center diameter (mm) | 15 | 20 | 25 | 15 | 20 | 20 | 15 |
| | Center surface hardness (Shore D) | 30 | 30 | 30 | 30 | 30 | 30 | 28 |
| | 1st envelope layer material No. | a | a | a | a | a | e | a |
| | 1st envelope layer hardness H1 (Shore D) | 45 | 45 | 45 | 45 | 45 | 35 | 45 |
| | 1st envelope layer thickness (mm) | 2.5 | 2.5 | 2.5 | 2.5 | 2.5 | 2.5 | 2.5 |
| | 1st envelope layer surface hardness S1 (Shore D) | 46 | 46 | 46 | 46 | 46 | 36 | 46 |
| | 2nd envelope layer material No. | g | d | d | h | h | h | i |
| | 2nd envelope layer hardness H2 (Shore D) | 25 | 23 | 23 | 15 | 15 | 15 | 5 |
| | 2nd envelope layer thickness (mm) | 2.5 | 2.5 | 2.5 | 2.5 | 2.5 | 2.5 | 2.5 |
| | 2nd envelope layer surface hardness S2 (Shore D) | 26 | 24 | 24 | 16 | 16 | 16 | 7 |
| | 3rd envelope layer material No. | a | a | b | a | a | a | a |
| | 3rd envelope layer hardness H3 (Shore D) | 45 | 45 | 54 | 45 | 45 | 45 | 45 |
| | 3rd envelope layer thickness (mm) | 5 | 2.5 | 2.4 | 5 | 2.5 | 2.5 | 5 |
| | 3rd envelope layer surface hardness S3 (Shore D) | 46 | 46 | 55 | 46 | 46 | 46 | 46 |
| | 4th envelope layer material No. | b | b | k | b | b | b | b |
| | 4th envelope layer hardness H4 (Shore D) | 54 | 54 | 65 | 54 | 54 | 54 | 54 |
| | 4th envelope layer thickness (mm) | 2.4 | 2.4 | 1.0 | 2.4 | 2.4 | 2.4 | 2.4 |
| | 4th envelope layer surface hardness S4 (Shore D) | 55 | 55 | 66 | 55 | 55 | 55 | 55 |
| | 5th envelope layer material No. | k | k | l | k | k | k | k |
| | 5th envelope layer hardness H5 (Shore D) | 65 | 65 | 32 | 65 | 65 | 65 | 65 |
| | 5th envelope layer thickness (mm) | 1.0 | 1.0 | 0.5 | 1.0 | 1.0 | 1.0 | 1.0 |
| | 5th envelope layer surface hardness S5 (Shore D) | 66.0 | 66.0 | 65.0 | 66.0 | 66.0 | 66.0 | 66.0 |
| | 5th envelope layer material No. | l | l | — | l | l | l | l |
| | 6th envelope layer hardness H6 (Shore D) | 32 | 32 | — | 32 | 32 | 32 | 32 |
| | 6th envelope layer thickness (mm) | 0.5 | 0.5 | — | 0.5 | 0.5 | 0.5 | 0.5 |
| | 6th envelope layer surface hardness S6 (Shore D) | 65 | 65 | — | 65 | 65 | 65 | 65 |
| | H0-H2 | 4 | 6 | 6 | 14 | 14 | 14 | 22 |
| | Hn-1-H0 | 36 | 36 | 36 | 36 | 36 | 36 | 38 |
| Properties | Compression deformation amount (mm) | 2.8 | 2.83 | 3.13 | 2.86 | 2.9 | 3.02 | 2.79 |
| | Iron spin rate Si (rpm) | 5320 | 5150 | 4960 | 4810 | 4910 | 4900 | 4940 |
| | Approach spin rate Sa (rpm) | 6750 | 6730 | 6520 | 6650 | 6630 | 6680 | 6700 |
| | Si/Sa | 0.79 | 0.77 | 0.76 | 0.72 | 0.74 | 0.73 | 0.74 |

TABLE 7

| | | Golf ball No. | | | | | | | |
|---|---|---|---|---|---|---|---|---|---|
| | | 21 | 22 | 23 | 24 | 25 | 26 | 27 | 28 |
| Structure | Center material No. | c | c | g | f | e | f | a | f |
| | Center hardness H0 (Shore D) | 27 | 27 | 25 | 29 | 35 | 29 | 45 | 29 |
| | Center diameter (mm) | 20 | 25 | 15 | 20 | 15 | 15 | 15 | 15 |
| | Center surface hardness (Shore D) | 28 | 28 | 26 | 30 | 36 | 30 | 46 | 30 |
| | 1st envelope layer material No. | a | a | a | a | g | a | g | g |
| | 1st envelope layer hardness H1 (Shore D) | 45 | 45 | 45 | 45 | 25 | 45 | 25 | 25 |
| | 1st envelope layer thickness (mm) | 2.5 | 2.5 | 2.5 | 5 | 2.5 | 2.5 | 2.5 | 2.5 |
| | 1st envelope layer surface hardness S1 (Shore D) | 46 | 46 | 46 | 46 | 26 | 46 | 26 | 26 |
| | 2nd envelope layer material No. | i | i | h | g | h | a | a | a |
| | 2nd envelope layer hardness H2 (Shore D) | 5 | 5 | 15 | 25 | 15 | 45 | 45 | 45 |
| | 2nd envelope layer thickness (mm) | 2.5 | 2.5 | 2.5 | 2.5 | 2.5 | 7.5 | 7.5 | 7.5 |
| | 2nd envelope layer surface hardness S2 (Shore D) | 7 | 7 | 16 | 26 | 16 | 45 | 45 | 45 |
| | 3rd envelope layer material No. | a | b | a | b | a | b | b | g |
| | 3rd envelope layer hardness H3 (Shore D) | 45 | 54 | 45 | 54 | 45 | 54 | 54 | 25 |
| | 3rd envelope layer thickness (mm) | 2.5 | 2.4 | 5 | 2.4 | 5 | 2.4 | 2.4 | 2.4 |
| | 3rd envelope layer surface hardness S3 (Shore D) | 46 | 55 | 46 | 55 | 46 | 55 | 55 | 26 |
| | 4th envelope layer material No. | b | k | b | k | b | k | k | k |

TABLE 7-continued

| | | Golf ball No. | | | | | | | |
|---|---|---|---|---|---|---|---|---|---|
| | | 21 | 22 | 23 | 24 | 25 | 26 | 27 | 28 |
| | 4th envelope layer hardness H4 (Shore D) | 54 | 65 | 54 | 65 | 54 | 65 | 65 | 65 |
| | 4th envelope layer thickness (mm) | 2.4 | 1.0 | 2.4 | 1.0 | 2.4 | 1.0 | 1.0 | 1.0 |
| | 4th envelope layer surface hardness S4 (Shore D) | 55 | 66 | 55 | 66 | 55 | 66 | 66 | 66 |
| | 5th envelope layer material No. | k | l | k | l | k | l | l | l |
| | 5th envelope layer hardness H5 (Shore D) | 65 | 32 | 65 | 32 | 65 | 32 | 32 | 32 |
| | 5th envelope layer thickness (mm) | 1.0 | 0.5 | 1.0 | 0.5 | 1.0 | 0.5 | 0.5 | 0.5 |
| | 5th envelope layer surface hardness S5 (Shore D) | 66.0 | 65.0 | 66.0 | 65 | 66.0 | 65 | 65 | 65 |
| | 5th envelope layer material No. | l | — | l | — | l | — | — | — |
| | 6th envelope layer hardness H6 (Shore D) | 32 | — | 32 | — | 32 | — | — | — |
| | 6th envelope layer thickness (mm) | 0.5 | — | 0.5 | — | 0.5 | — | — | — |
| | 6th envelope layer surface hardness S6 (Shore D) | 65 | — | 65 | — | 65 | — | — | — |
| | H0-H2 | 22 | 22 | 10 | 4 | 20 | −16 | 0 | −16 |
| | Hn-1-H0 | 38 | 38 | 40 | 36 | 30 | 36 | 20 | 36 |
| Properties | Compression deformation amount (mm) | 3.05 | 3.24 | 2.84 | 2.82 | 3.07 | 2.64 | 2.45 | 2.95 |
| | Iron spin rate Si (rpm) | 4840 | 4850 | 4760 | 5250 | 4890 | 5580 | 5800 | 5620 |
| | Approach spin rate Sa (rpm) | 6490 | 6410 | 6650 | 6750 | 6680 | 6600 | 6800 | 6600 |
| | Si/Sa | 0.75 | 0.76 | 0.72 | 0.78 | 0.73 | 0.85 | 0.85 | 0.85 |

From the results of Tables 4 to 7, it can be seen that, multi-piece golf balls comprising a center and n (n is a natural number of 3 or more) envelope layers covering the center, wherein material hardness of the envelope layers satisfies H2<H0<Hn−1; where the envelope layers formed in order from the center side are referred to as a first envelope layer, a second envelope layer, a third envelope layer, a fourth envelope layer, . . . an n−1th envelope layer and an nth envelope layer (the outmost layer), respectively and H0 is a material hardness (Shore D hardness) of the center, and H1, H2, H3, H4, . . . Hn−1 and Hn are material hardness (Shore D hardness) of the first envelope layer, the second envelope layer, the third envelope layer, the fourth envelope layer, . . . the n−1th envelope layer and the nth envelope layer (the outmost layer), respectively; and the center is formed from a thermoplastic resin composition, and the second envelope layer is formed from a thermoplastic resin composition or a rubber composition, show a low spin rate on iron shots and a high spin rate on approach shots. As a result, the multi-piece golf balls of the present invention travel a great distance on iron shots and stops quickly on approach shots.

The present invention is useful as a golf ball travelling a great distance on iron shots and stopping quickly on approach shots. This application is based on Japanese Patent Application No. 2013-133805 and No. 2013-133807 filed on Jun. 26, 2013, the contents of which are hereby incorporated by reference.

The invention claimed is:

1. A multi-piece golf ball comprising a center and n (n is a natural number of 4 or more) envelope layers covering the center, wherein material hardness of the envelope layers satisfies H2<H0<Hn−1;

the envelope layers formed in order from the center side are referred to as a first envelope layer, a second envelope layer, . . . an n−1th envelope layer and an nth envelope layer (the outmost layer), respectively, and H0 is a material hardness (Shore D hardness) of the center, and H1, H2 . . . Hn−1 and Hn are material hardness (Shore D hardness) of the first envelope layer, the second envelope layer, . . . the n−1th envelope layer and the nth envelope layer (the outmost layer), respectively;

the center is formed from a thermoplastic resin composition;

the second envelope layer is formed from a thermoplastic resin composition or a rubber composition;

the second envelope layer has a lowest hardness (Shore D hardness) among the envelope layers from the first envelope layer to the n−1th envelope layer;

a hardness difference ((Hn−1)−H0) between the material hardness Hn−1 (Shore D hardness) of the n−1th envelope layer and the material hardness H0 (Shore D hardness) of the center ranges from 36 to 75; and the second envelope layer has material hardness H2 (Shore D hardness) ranging from 3 to 35.

2. The multi-piece golf ball according to claim 1, wherein the center has a material hardness H0 (Shore D hardness) ranging from 5 to 60.

3. The multi-piece golf ball according to claim 1, wherein the center has a diameter ranging from 5 mm to 25 mm.

4. The multi-piece golf ball according to claim 1, wherein a hardness difference (H0−H2) between the material hardness H0 (Shore D hardness) of the center and the material hardness H2 (Shore D hardness) of the second envelope layer ranges from 1 to 57.

5. The multi-piece golf ball according to claim 1, wherein the second envelope layer is formed from the thermoplastic resin composition, and the thermoplastic resin composition forming the second envelope layer contains, as a resin component, at least one kind selected from the group consisting of an ionomer resin, a thermoplastic olefin copolymer, a thermoplastic styrene-based elastomer, a thermoplastic polyester elastomer, a thermoplastic polyurethane elastomer, a thermoplastic polyamide elastomer, and a thermoplastic acrylic-based elastomer.

6. The multi-piece golf ball according to claim 5, wherein the thermoplastic resin composition forming the second envelope layer contains the ionomer resin, and the ionomer resin is a ternary ionomer resin.

7. The multi-piece golf ball according to claim 1, wherein the nth envelope layer (the outmost layer) has a material hardness Hn (Shore D hardness) ranging from 5 to 55.

8. The multi-piece golf ball according to claim 1, wherein the first envelope layer has a material hardness H1 (Shore D hardness) ranging from 3 to 45.

9. The multi-piece golf ball according to claim 1, wherein the n−1th envelope layer has a material hardness Hn−1 (Shore D hardness) ranging from 45 to 80.

10. The multi-piece golf ball according to claim 1, wherein a hardness difference ((Hn−1)−H2) between the material hardness Hn−1 (Shore D hardness) of the n−1th envelope layer and the material hardness H2 (Shore D hardness) of the second envelope layer ranges from 5 to 77.

11. The multi-piece golf ball according to claim 1, wherein n is a natural number of 10 or less.

12. The multi-piece golf ball according to claim 1, wherein the material hardness satisfies H1>H2<H3<H4 . . . <Hn−3<Hn−2<Hn−1, wherein H3 corresponds to a third envelope layer and H4 corresponds to a fourth envelope layer.

13. The multi-piece golf ball according to claim 1, wherein surface hardness (Shore D hardness) of the envelope layers satisfies S1>S2<S3<S4< . . . <Sn−3<Sn−2<Sn−1, where S1, S2, S3, S4, . . . and, Sn−1 are surface hardness (Shore D hardness) of the first envelope layer, the second envelope layer, the third envelope layer, the fourth envelope layer, . . . the n−1th envelope layer, respectively.

14. The multi-piece golf ball according to claim 1, wherein each layer from the first envelope layer to the n−1th envelope layer has a thickness of 15 mm or less.

15. The multi-piece golf ball according to claim 1, wherein the nth envelope layer (the outmost layer) has a thickness of 2.0 mm or less.

16. The multi-piece golf ball according to claim 1, wherein the thermoplastic resin composition forming the center contains an ionomer resin, a thermoplastic olefin copolymer, a thermoplastic styrene-based elastomer or a mixture thereof.

17. The multi-piece golf ball according to claim 16, wherein the thermoplastic resin composition forming the center contains the thermoplastic styrene-based elastomer, and the thermoplastic styrene-based elastomer is an alloy of a polyolefin with one kind or two or more kinds selected from the group consisting of a styrene-butadiene-styrene block copolymer (SBS), a styrene-isoprene-styrene block copolymer (SIS), a styrene-isoprene-butadiene-styrene block copolymer (SIBS), a styrene-ethylene-butylene-styrene block copolymer (SEBS), a styrene-ethylene-propylene-styrene block copolymer (SEPS), a styrene-ethylene-ethylene-propylene-styrene block copolymer (SEEPS) and hydrogenated products thereof.

18. The multi-piece golf ball according to claim 1, wherein the second envelope layer has a lowest hardness (Shore D hardness) among the envelope layers from the first envelope layer to the n−1th envelope layer, a hardness difference (H0−H2) between the material hardness H0 (Shore D hardness) of the center and the material hardness H2 (Shore D hardness) of the second envelope layer ranges from 1 to 57, a hardness difference ((Hn−1)−H0) between the material hardness Hn−1 (Shore D hardness) of the n−1th envelope layer and the material hardness H0 ranges from 36 to 75, a hardness difference (H0−H1) between the material hardness H0 and the material hardness H1 (Shore D hardness) of the first envelope layer ranges from 2 to 40, and a hardness difference ((Hn−1)−H2) between the material hardness Hn−1 and the material hardness H2 ranges from 5 to 77.

* * * * *